US006237691B1

(12) United States Patent
Kelley et al.

(10) Patent No.: US 6,237,691 B1
(45) Date of Patent: May 29, 2001

(54) METHOD AND APPARATUS FOR INCREASING FLUID RECOVERY FROM A SUBTERRANEAN FORMATION

(75) Inventors: Terry E. Kelley, Berkeley, CA (US); Robert E. Snyder, Houston, TX (US)

(73) Assignee: Kelley & Sons Group International, Inc.

( * ) Notice: Subject to any disclaimer, the term of this patent is extended or adjusted under 35 U.S.C. 154(b) by 0 days.

(21) Appl. No.: 09/590,152

(22) Filed: Jun. 8, 2000

Related U.S. Application Data

(62) Division of application No. 08/978,702, filed on Nov. 26, 1997, now Pat. No. 6,089,322.
(60) Provisional application No. 60/032,218, filed on Dec. 2, 1996.

(51) Int. Cl.[7] ..... E21B 43/18
(52) U.S. Cl. ..... 166/370; 166/105.5; 166/106
(58) Field of Search ..... 166/105.5, 106, 166/369, 370, 372

(56) References Cited

U.S. PATENT DOCUMENTS

| | | | | |
|---|---|---|---|---|
| 1,507,454 | | 9/1924 | Blackburn . | |
| 1,757,267 | | 5/1930 | Stanley . | |
| 2,291,902 | | 8/1942 | Kelley . | |
| 2,434,239 | | 1/1948 | Zublin . | |
| 2,810,352 | * | 10/1957 | Tumlison | 166/54 |
| 3,324,803 | | 6/1967 | Kelley et al. . | |
| 3,363,581 | | 1/1968 | Kelley et al. . | |
| 3,408,949 | | 11/1968 | Hart, Jr. . | |
| 3,410,217 | | 11/1968 | Kelley et al. . | |
| 3,451,477 | | 6/1969 | Kelley . | |
| 3,483,827 | | 12/1969 | Hooper . | |
| 3,643,740 | | 2/1972 | Kelley . | |
| 3,653,438 | | 4/1972 | Wagner . | |
| 3,724,486 | | 4/1973 | Douglas . | |
| 3,971,213 | | 7/1976 | Kelley . | |
| 3,993,129 | | 11/1976 | Watkins . | |
| 4,042,029 | | 8/1977 | Offeringa . | |
| 4,345,647 | | 8/1982 | Carmichael . | |
| 4,474,234 | | 10/1984 | Lefebvre et al. . | |
| 4,570,718 | | 2/1986 | Adams, Jr. . | |
| 4,589,482 | * | 5/1986 | Bayh, III | 166/105.5 |
| 4,596,516 | * | 6/1986 | Scott et al. | 417/58 |
| 4,643,258 | * | 2/1987 | Kime | 166/369 |
| 5,257,665 | * | 11/1993 | Watkins | 166/372 |
| 5,343,945 | * | 9/1994 | Weingarten et al. | 166/105.5 |
| 5,450,901 | * | 9/1995 | Ellwood | 166/266 |
| 5,456,318 | | 10/1995 | Priestly . | |
| 5,535,825 | | 7/1996 | Hickerson . | |
| 5,653,286 | | 8/1997 | McCoy et al. . | |
| 5,655,604 | | 8/1997 | Newton . | |
| 5,664,628 | | 9/1997 | Koehler et al. . | |

OTHER PUBLICATIONS

World Oil, Jul. 1972, 4 pp.

* cited by examiner

*Primary Examiner*—Hoang Dang
(74) *Attorney, Agent, or Firm*—Browning Bushman

(57) ABSTRACT

A downhole injector 10, 26, 38 and 54 is provided at the lower end of the production tubing string TS for passing liquids from a downhole formation into the tubing string while preventing gases from passing through the injector. The injector may include an improved screen 36 for preventing formation sand from entering the injector. The system may include a packer 44 in the annulus A above the injector. In one application, a vent tube 46 extends upward from the packer into the annulus for maintaining a desired liquid level in the annulus above the packer. A plurality of through ports 40 establish fluid communication in the annulus above the packer and the production tubing string so that a downhole pump P may efficiently pump downhole fluids to the surface. The injector of the present invention may be used with one or more lift valves LV for raising slugs of liquid upward to the surface through the production tubing string. The present invention may also be used with horizontal bore hole technology for increased hydrocarbon recovery by retaining the gases downhole to act upon liquid hydrocarbons and maintaining a driving force for pushing the liquids toward the injector for recovery.

16 Claims, 8 Drawing Sheets

METHOD AND APPARATUS FOR INCREASING FLUID RECOVERY FROM A SUBTERRANEAN FORMATION

This application is a Divisional of application Ser. No. 08/978,702, filed on Nov. 26, 1997, now U.S. Pat. No. 6,089,322, which is based on a Provisional Application No. 60/032,218, filed Dec. 2, 1996.

FIELD OF THE INVENTION

The present invention relates to a liquid/gas separator for positioning in the lower part of a well intended for the production of fluids, such as hydrocarbons. The separator prevents the entry of gas into the production tubing string, but allows the entry of fluid in liquid form. The invention also relates to a method for improving the primary, secondary or tertiary recovery of reservoir hydrocarbons and to improved systems involving downhole liquid/gas separators for various hydrocarbon recovery applications.

BACKGROUND OF THE INVENTION

Hydrocarbon recovery operations commonly allow reservoir gas within the formation to flow into the wellbore and to the surface with the liquid hydrocarbons. This practice initially drives high volumes of hydrocarbons into the well and up through the production tubing. Conventional hydrocarbon producing methods thus allow, and in many cases rely upon, the pressurized reservoir gases to directly assist in lifting the production fluids to the surface. This practice thus utilizes the pressure and liquid-driving capabilities of the reservoir gas to improve early well production recovery. While prevalent, this practice significantly reduces the ultimate recovery of liquid hydrocarbon reserves from the formation.

Liquid/gas separators have been used downhole in producing oil and gas wells to allow the entry of reservoir fluids which are in the liquid state into the tubular string that conveys the liquid fluids to the surface, and to prevent the entry of fluids in the gaseous state into the producing tubular string. One type of separation device, which remains immersed in the surrounding downhole fluid, includes a float and a valve arrangement. When this separation device is full of liquid, an open conduit is provided from the reservoir to the producing tubular. When the liquid is displaced by gas in the separation device, the float rises due to its increased buoyancy and a valve closes to prevent the entry of fluids into the producing tubular.

This separator thus includes a float activated valving system which opens when the separator is full of liquid and closes when that liquid is displaced by gas. The flotation system within this separator is configured to operate in the vertical or substantially vertical orientation. When the liquid/gas separator is open, the separator allows liquid to be transmitted by pressure energy within the producing formation upward through the tubular string which is positioned above a standing or check valve, and then to be lifted to the surface by a conventional pump powered by a reciprocating or rotating (progressive cavity) rod string. Other types of available downhole pumps, such as electrical submersible pumps or hydraulic (jet-type) pumps, may also be used to lift the liquid to the surface once it is entrapped above the liquid gas separator and within the production tubing string.

In practice, the downhole separator does little to cause or accelerate the separation of liquid and gas. Rather, the device senses the presence of a gas or a liquid within the device by the float, and allows only liquid entry into the production tubing string. The separator thus operates within a downhole well in a manner similar to a float operated valve controller which detects the liquid/gas interface within a surface vessel. One type of separation device marketed as the Korkele downhole separator has proven effective in many installations.

The separator may be placed and operated within a cased we ilbore with a conventional diameter casing therein or may also be operated in an open hole. In either case, the separator may be suspended in the well from production tubing. The basic advantage of the Korkele downhole separator is that it improves performance of the well and the well-reservoir production system by allowing for the production of liquids only, i.e., it prevents the entry of gas from the reservoir into the production tubular string. The downhole separator as discussed above is more fully described in a July 1972 article in World Oil, pages 37–42. Further details with respect to this separator are disclosed in U.S. Pat. No. 3,643,740 granted to Kork E. Kelley and hereby incorporated by reference.

Other prior art includes U.S. Pat. Nos. 1,507,454 and 1,757,267. The '454 patent discloses an automatic pump control system with an upright stem connected to a diaphragm to operate a standing valve. The '267 patent discloses a gas/oil separator having a separating chamber located within the tubing and a mechanism for diverting the path of oil over an enlarged contact surface to separate free oil from gas.

U.S. Patents naming Kork Kelly as an inventor or co-inventor include U.S. Pat. Nos. 2,291,902; 3,410,217; 3,324,803; 3,363,581; and 3,451,477. The '902 patent discloses a gas anchor having a float connected to a valve stem which operates a valve head. The '217 patent discloses a separator for liquid control in gas wells. The '803 patent discloses a device having a floating bucket connected by a rod for liquid/gas wells. A valve member is disclosed below and in close proximity to a check ball. The '581 patent discloses a pressure balanced and full-opening gas lift valve. The '477 patent relates to an improved method for effecting gas control in oil wells. The device includes a flotation bucket with an open top and a valve string including a valve member connected to the top of a rod, with the bottom of the rod connected to the bottom bucket. The '740 patent discloses both methods and apparatus for effecting gas control in oil wells utilizing a flotation bucket with an open top and a valve string including a valve member connected to the top of a rod. U.S. Pat. No. 3,971,213 discloses an improved pneumatic beam pumping unit.

U.S. Pat. No. 3,408,949 discloses a bottom hole gas/liquid separator having a float tube encircling the lower end of a production tubing and adapted to move vertically within a housing. A production valve is disposed on the upper end of a spacer bar such that the float tube and spacer bar form a sand trap. U.S. Pat. No. 3,483,827 discloses a well producing device which utilizes a gas separator in a tubing string to separate liquid from gas prior to entry into a downhole pump. U.S. Pat. No. 3,724,486 discloses a liquid and gas separation device for a downhole well wherein a valve member is moveable and resiliently mounted on a moveable liquid container designed so that liquid will accumulate within the bore hole above the position where gas enters to decrease or prohibit the entry of gas into the bore hole. U.S. Pat. No. 3,993,129 discloses a fluid injection valve for use in well tubing for controlling the flow of fluid between the outside of the production tubing and the inside of the tubing.

More recently issued patents include U.S. Pat. Nos. 4,474,234 and 4,570,718. The '234 patent discloses a hydrocarbon production well having a safety valve removably mounted in the production tubing beneath a pump. The '718 patent relates to an oil level sensor system and method for operating an oil well whereby upper and lower oil well sensors control pumping of the well. U.S. Pat. No. 5,456,318 discloses a fluid pumping device having a fluid inlet valve disposed at its lower end for fluid flow into the body of the device, a plunger assembly disposed in the interior of the body for reciprocating movement, a seal which cooperates with the plunger assembly to divide the body into isolated upper and lower chambers and to divide the body from the production tube, and fluid flow control valves.

U.S. Pat. No. 5,653,286 discloses a downhole gas separator connected to the lower end of a tubing string designed such that primary liquid fluid flows into a chamber within the separator. U.S. Pat. No. 5,655,604 discloses a downhole production pump and circulating system which utilizes valves wherein the valve balls are attached to projector stems. U.S. Pat. No. 5,664,628 discloses an improved filter medium for use in subterranean wells.

None of the prior art discussed above fully benefits from the capability of an effective downhole liquid/gas separator. Further improvements are required to obtain the significant advantages realized by retaining within the downhole producing formation the inherent energy, i.e. the compressed gas, which drives the desired hydrocarbon products from the reservoir rock and into the wellbore so that they may be more efficiently produced. By preventing the formation gas at bottom of the well from entering the production tubing string and permitting only the entry of liquids into the tubing string, the retained potential energy and expansive properties of the gas may be effectively utilized to produce a higher percentage of liquid reserves than would otherwise be recovered by conventional technology. Alternatively, improved procedures for pumping liquid accumulations off gas wells are necessary to improve the performance of gas wells. Moreover, further improvements in a separation device, in methods of using a separation device, and in the configuration and operation of the overall hydrocarbon recovery system in which a separation device is employed are required to benefit from the numerous applications in which such a device may be effectively used to enhance recovery of hydrocarbons.

The disadvantages of the prior art are overcome by the present invention. An improved separation device, a method of operating a separation device, an improved overall hydrocarbon recovery system, and improved techniques for recovering hydrocarbons are hereinafter disclosed.

SUMMARY OF THE INVENTION

The present invention discloses an improved downhole liquid injector and improved techniques utilizing an injector for recovering hydrocarbons from producing reservoirs. Several basic concepts influence the benefits of utilizing the liquid injector of the present invention in various existing and planned well and/or reservoir producing systems. First, positive prevention of gas into the producing tubular improves the efficiency of an artificial lift pumping system by allowing the lift system to handle primarily liquids rather than a combination of liquids and gases. By providing for the positive prevention of gas into the production tubing, the artificial lift pumping system is efficiently pumping only primarily liquids. Conventional artificial lift systems which utilize a rod string to power a downhole pump thus operate more efficiently with liquid only flowing through the production tubing string. Preventing gas lock in downhole positive displacement and electrical submersible pumps is a major problem for the oil well operator with existing technology. Since the injector of the present invention substantially reduces or eliminates unwanted gas to the production tubing string, gas lock is avoided and the life and efficiency of positive displacement and submersible pumps is increased.

By preventing gas entry downhole into the production tubing string, the present invention also reduces the possibility of gas blowout through the surface production system. The present invention also reduces sucker rod stuffing box drying and wear to reduce leakage of fluids from the wellhead and minimize environmental problems associated with producing hydrocarbons.

The system of the present invention may significantly benefit from the concept of preventing gas production from the reservoir and thereby retaining the gas within the reservoir where it will continue to supply energy in the form of pressure to drive well fluids into the producing wellbore. By permitting only the inflow of reservoir liquids into the production tubing string and maintaining gases on the top of a liquid column in the well, a high percentage of natural gas remains in the reservoir where it provides the pressure to drive liquids toward the wellbore and creates a more efficient drainage mechanism to best utilize the principles of gravity separation.

By keeping gas within the reservoir, the present invention also creates a more effective liquid drainage pattern within the reservoir by reducing gas coning around the well and improving the maintenance of an effective gas cap drive to develop an enhanced liquid gravity drainage system. The system of the present invention thus acts to oppose the release of gas from the formation into the we ilbore and minimize undesirable coning of a gas cap, while also promoting the generation and maintenance of a more effective gas cap drive.

By retaining the gas in the reservoir, the flow of desired liquid hydrocarbons into the we ilbore is also assisted by retaining gas in solution within the crude oil to maintain a lower fluid viscosity, thereby lowering the resistance to flow of the crude oil through the reservoir. Since reservoir rock has a lower relative permeability to liquids than to gas, particularly when the crude loses its lighter components and becomes heavy, minimizing gas inflow and maintaining reservoir pressure keeps the crude more gas saturated and less viscous so that it is mobile and may more freely flow toward the wellbore area.

The injector of the present invention may also be used to significantly improve the efficiency of a downhole system designed to remove liquids, typically water, from the we ilbore which impede the production of natural gas from a gas reservoir. By providing for the efficient removal of problem liquids which impede the production of gases from primarily gas reserve reservoirs, the efficiency of a gas recovery system may be significantly enhanced. Systems with a positive downhole gas shutoff for removing liquid accumulations will also be safer to operate since gas flow to the surface through the tubing string may be automatically and positively controlled if surface control is lost.

The techniques of the present invention may be used to improve long-term productivity and increase the recovery of hydrocarbon reserves from many existing oilfields. In new oilfields, particularly those in which it is desirable to prevent or limit the wasteful production or uneconomical recovery of natural gas which lowers ultimate crude recovery, the present invention offers a valuable completion option. Such new fields are continually being discovered and developed in isolated offshore locations, and in many countries which are just now developing their petroleum reserves.

The downhole separation device of the present invention, which is more properly termed a liquid injector, is a float-operated device that permits producing reservoir fluids to flow into a production tubing string but positively shuts off the entry of gas. In a preferred embodiment, the injector prevents entry of fine-grain sand into the interior of the injector tool by utilizing an improved screening device to provide significantly increased protection from sand entry and minimize filling and plugging by the fine-grained sand particles. The sand particle sizes excluded by the screening device do not significantly impede fluid flow. The screening device also provides advantages relating to the breakup of foams in the wellbore to enhance the flow of liquid rather than gas into the interior of the injector. In one embodiment of the injector, the flow shutoff valve is located at a high position within or above the intake tube and close to the standing or check valve. This positioning of the shutoff valve causes liquids in the intake tube to remain under wellbore pressure while the shutoff valve is closed, thus preventing the release of solution gas in response to pressure reduction caused by the pumping action, thus reducing problems associated with pump gas lock. Raising the shutoff valve also keeps the shutoff valve out of the lower area of the float in which sand may settle during the time the valve is closed, thus further minimizing the possibility of sand plugging.

An improved method is provided for creating a liquid reservoir within a well pumping or producing system. According to one technique, liquid does not flow directly into the pump intake, and instead the wellbore formation fluid is first diverted into a vertical reservoir created in an annulus between the tubing and the casing by addition of a packer. The downhole pump may then draw from this reservoir. Should the injector shutoff valve close, the pump would continue to draw liquid until the working fluid level drops to the pump intake. An additional benefit from this concept occurs as a result of further solution gas breakout and separation within the vertical reservoir. The gas from the producing formation below the packer may be vented through a vent tube containing a pressure regulation system to ensure wellbore pressure sufficient to lift liquid to a working level above a pump. This system may also benefit from the use of various back pressure controls and fluid entry and reversal mechanisms.

The injector of the present invention may also be combined with an improved beam pumping unit as described in U.S. Pat. No. 3,971,213. This integrated system uses power derived from the pressure of natural gas produced in the annulus in the previously described liquid reservoir. After pressure reduction at the surface, the produced gas may be routed into a flow line for sale. No waste or burning of produced gas is required, and instead a self-contained operation is achieved.

The techniques of the present invention minimize the production of gas which, in many applications, is wasted and flared. By providing a controlled back pressure relief in a gas lifted well, a gas lift system in a flowing well may be configured with double packers to create a chamber above the producing formation. A tubing regulator device controls the pressure of entrapped gas from the we ilbore which is relieved into the chamber, which in turn provides a desired pressure differential across the formation and to the wellbore. Gas in the chamber may further act as a first lifting stage for slugs of liquid entering the tubing. Various modifications to this technique are more fully discussed below. The techniques of the present invention may also be used to increase productivity in horizontal wells, as discussed further below. The techniques of the present invention may thus be used to increase liquid hydrocarbon recovery by conserving and utilizing natural gas as a reservoir driving mechanism so that a gas cap pushes the liquid downward to a lower horizontal bore hole or lateral.

It is an object of the present invention to provide improved equipment and methods for recovering hydrocarbons from subterranean formations. More particularly, the present invention may function to retain a pressurized gas reservoir downhole and thereby improve recovery of liquid hydrocarbons, and may also be used to remove liquids which block the effective recovery of gaseous hydrocarbons. The improved method of producing hydrocarbons from a well serves to more efficiently retain and utilize the inherent energy of natural gas within the reservoir. A properly designed system according to the present invention may create a reservoir producing mechanism that minimizes production problems and recovers significantly greater volumes of liquid hydrocarbon reserves.

It is a feature of the present invention that the techniques described herein may be used for maintaining a downhole reservoir so that the liquid injector may operate independent of an artificial lift system for the well. The methods of the present invention may also utilize a liquid injector below an annular seal or packer between the tubing and casing to provide for and control the relief of wellbore gas pressure buildup above the liquid in the wellbore and thereby optimize reservoir inflow performance. The liquid injector may also be incorporated with a gas lift system to achieve a design with enhanced wellbore to reservoir pressure drawdown and inflow patterns. The techniques of the present invention may be used to enhance hydrocarbon recovery from highly deviated or horizontal wellbores, and may also be used in directional well drilling and completion techniques.

One feature of the present system is that the injector provides benefits from improved control by preventing formation gas production with the production of liquids. The injector incorporates an improved sand filter and may utilize a liquid reservoir above a packer, and optionally employs a shutoff valve located closer to the pump. The techniques of the present invention may be used to minimize and prevent gas locking in pumped wells, and also minimize the likelihood of gas blowout to surface by allowing the injector to act as a downhole gas shutoff device. The techniques of the present invention further result in improved lubrication for the polished rod to minimize leakage of hydrocarbons through the stuffing box. The present invention may be used to effectively de-water gas wells by removing liquids that prevent optimum gas production. In wells in which liquid hydrocarbons are produced, gas waste is minimized and conservation of gas enhances gas drive capabilities.

A significant feature of the present invention is the improved long-term productivity and increased recovery of hydrocarbon reserves of existing oilfields. In new fields, the systems of the present invention provide an effective completion option over existing technology. By retaining a high percentage of natural gas within the reservoir and producing the oil by gravity drainage, more oil is recovered.

An advantage of the present invention is that highly sophisticated equipment and techniques are not required to significantly improve the production of hydrocarbons. Another significant advantage of the invention is the relatively low cost of the equipment and operating techniques as described herein compared to the significant advantages realized by the well operator. Moreover, the useful life of other hydrocarbon production equipment, such as downhole positive displacement pumps and wellhead stuffing boxes, is improved by the system provided by this invention.

These and further objects, features, and advantages of this invention will become apparent from the following detailed description, wherein reference is made to the figures in the accompanying drawings.

DETAILED DESCRIPTION OF PREFERRED EMBODIMENTS

Injector Features and Operation

Figure 1:
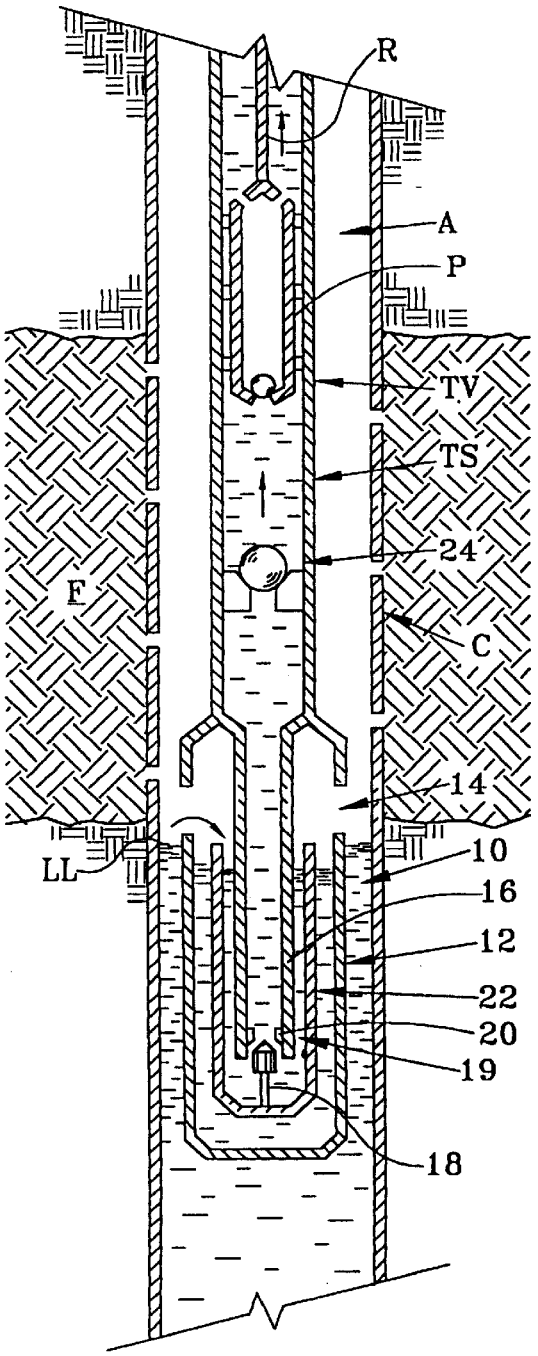
FIG. 1 is a simplified pictorial view of an injector according to the present invention suspended from a tubing string within the interior in a casing of a wellbore. The downhole float and valve mechanisms are simplistically depicted for easy understanding of the injector.

FIG. 1 simplistically illustrates the primary components of a liquid injector 10 according to the present invention suspended in a tubing string TS within a downhole well passing through a hydrocarbon-bearing formation F. Injector 10 is thus positioned within the lower end of a casing C which is perforated to allow formation fluids to flow into the interior of the casing C and thus surround the injector 10. Also simplistically shown in FIG. 1 is a downhole pump P which may be powered by surface equipment such as a pump jack (not shown), with the power being transmitted from the surface to the pump via a sucker rod R positioned within the production tubing string TS. The pump P includes a lower pump traveling valve TV which allows fluids to pass upward from the liquid injector 10 and into the pump, and then be transmitted through the production tubing TS to the surface. As explained further below, a liquid level LL within the casing C is ideally maintained by the injector 10 to allow liquid hydrocarbons to be transmitted to the pump P and then to the surface via the tubing string TS, while the annulus A between the tubing string TS and the casing C above the liquid level is occupied by pressurized gas.

The liquid injector 10 as shown in FIG. 1 includes an outer housing 12 with a plurality of intake perforations 14 which allow liquid within the interior of the casing C to flow into the interior of the housing 12 and then into float 22 to surround vertical tube 16 which is in fluid communication with the lower end of the tubing string TS. An injector intake or shutoff valve 19 includes a valve member 18 that cooperates with shutoff seat 20 at the lower end of the tube 16, and the valve member 18 in turn moves with the float 22 which surrounds the tubing 16 to control the flow of liquid into the tube 16. The downhole float 22 thus operates in response to the liquids which surround it within housing 12. Valve member 18 thus lowers with respect to the housing 12 when the float 22 is filled with liquid, thereby opening the shutoff valve 19 and allowing liquids to flow upward into the tubing string past a standing or check valve 24 and enter the pump P. For most operations in which a pump P is used, the standing valve is part of the pump P and is immediately below the traveling valve TV. When gas in the annulus A displaces the liquid so that the liquid no longer flows through ports 14 into the float 22, the float 22 rises to close the valve 19 and prevent gas from entering the interior of the tubing string TS. The basic operation of the injector 10 is thus relatively simple, and the injector itself is inexpensive and reliable. The standing or check valve 24 thus prevents fluids which pass upward past this valve from returning by gravity back to the injector. Those skilled in the art will appreciate that the float 22 may have various configurations, and that other arrangements may be used so that the shutoff valve 19 is automatically responsive to the operation of the float.

Figure 2:
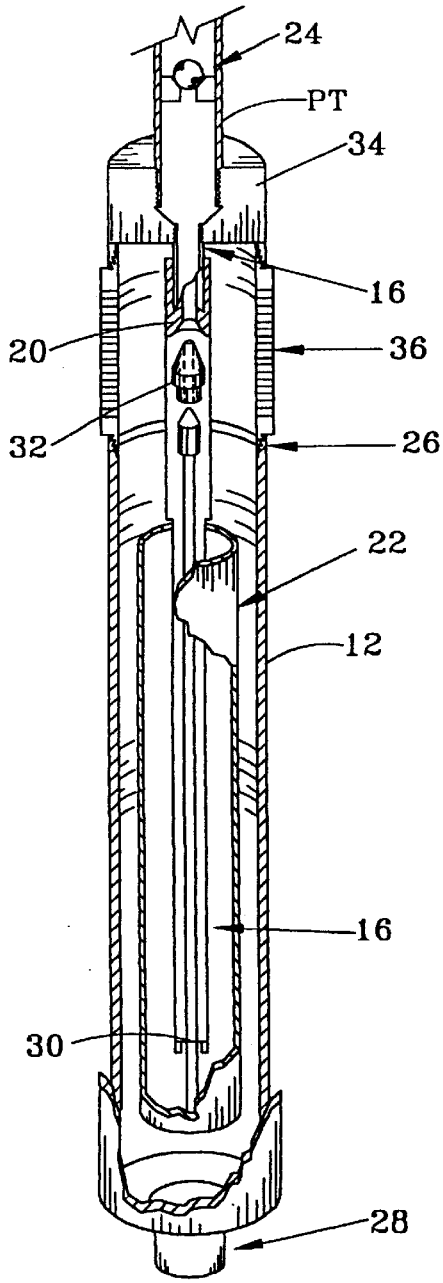
FIG. 2 is a simplified pictorial view of one embodiment of a liquid injector according to the present invention, including an improved sand screen.

FIG. 2 illustrates a modified liquid injector 26 according to the present invention which may similarly be suspended from a tubing string TS as shown in FIG. 1. The liquid injector 26 includes components previously described and, although the configuration of the components may be altered, the same reference numbers are used herein for functionally similar components. The injector 26 thus includes a float 22 moveable within a housing 12. At the lower end of the housing 12, a bull plug 28 is removable for threading a closed lower pipe which serves as a sand reservoir to the injector. For the embodiment shown in FIG. 2, valve member 19 has been replaced by a combination of an elongate moveable valve stem 30 and a valve body 32 positioned closely adjacent seat 20. The valve stem 30 is secured to the float 22 as previously described, although it is apparent that the intake or shutoff valve 19 for the injector 26 has been substantially raised compared to the previously described embodiment. Also, fluid flowing up to the shutoff valve 19 travels upward through a smaller diameter flow tube 16, where it may continue upward to a pump P as previously described. Immediately above the shutoff valve 19 is the standing valve 24 for the pump, as previously described. As with the operation of the previously described injector, the float lowers and raises the valve stem 30 to open and close the valve 19 using valve body 32. The valve body 32 opens to relieve the pressure differential when the float drops, and the valve closes when gas displaces the liquid. The valve body 32 has a relief port therein, as more fully described in U.S. Pat. No. 3,451,477. In a suitable application, the float 22 may have a three inch outer diameter and a length of approximately 30 feet, and may be fabricated from 16 gauge metal. The outer housing or jacket 12 of the injector 26 may have approximately a four inch outer diameter. FIG. 2 also shows an injector head 34 for structurally interconnecting the tube with the lower end of the production tubing PT. Also, it should be understood that the shutoff valve 19 as shown in FIG. 2 may be used in the lower part of the injector as shown in FIG. 1.

The housing 12 as shown in FIG. 2 does not include intake openings 14 and instead a sleeve-shaped sand screen 36 is provided. Fluids must thus pass through the sleeve-shaped screen 36 and into the interior of the housing or jacket 12. In prior art liquid/gas separators, the operation of the separator may be inhibited by formation sand which may build up in the float and restrict operation of the separator. The injector 26 as shown in FIG. 2 minimizes this problem by providing a sand filtering screen 36 across the primary fluid intake to the float. Various commercial screens 36 may be used, such as the Johnson (US Filter) prepacked screen or the Pall Corporation multilayer wire mesh screen. Screen 36 thus fits across or replaces a portion of the outer housing or shell of the injector to minimize sand plugging problems, while also not unduly restricting the flow of liquids into the injector. Preferred screen 36 may also assist in recovery of hydrocarbons by reducing foaming and separating liquids from gases. A preferred screen 36 according to the present invention preferably is adapted for blocking at least 90% of sand which has a particle size from 10 microns to 30 microns or larger from entering the interior of the injector, while allowing those few particles smaller than that size to pass through the screen and thus not unduly restrict fluid flow or cause screen plugging. The screen 36 may have threaded upper and lower ends for mating engagement with the housing 12 and with the head 34 which connects the screen 36 with the tubing string TS. The selection of the screen and its particle size blocking features will depend to a large extent upon the formation conditions and the downhole operations, and the characteristics of the desired screen may be altered with experience.

The injector 26 as shown in FIG. 2 has its intake or shutoff valve 19 for the injector positioned vertically upward relative to a lowermost end of the float 22. In prior art liquid/gas separators, there was conventionally a vertical spacing of approximately 30 feet or more between the intake or shutoff valve and any standing valve 24. When the lower shutoff valve closed, pressure in the 30 foot line between these components was lowered to a vacuum by the action of the pump P, which in some instances caused the liquid hydrocarbons in this 30 foot line to vaporize. When the lower shutoff valve then opened, the pumping systems could become gas locked. The improvement to the injector as shown in FIG. 2 relocates the shutoff valve significantly upward in the injector housing, and ideally immediately below the standing valve 24. More particularly, the vertical space between the shutoff valve 19 and the standing valve 24 is essentially eliminated and is now ideally less than ten times the outer nominal diameter of the housing 12, and preferably is less than about three times the outer nominal diameter of the housing 12. The shutoff valve is thus operated by long slender rod 30 affixed to the bottom of the float 22, with the rod extending upward toward the shutoff seat 20. By providing the shutoff valve closely adjacent the standing valve 24, the volume between these valves is reduced to allow immediate entry of liquid under wellbore pressure when the shutoff valve opens.

The design as shown in FIG. 2 thus solves two problems with prior art separation devices. First liquids in the long intake tube 16 do not remain under wellbore pressure when the shutoff valve is closed, which reduces the problem of pump gas lock as described above. Secondly, by raising the shutoff valve 19, it is kept out of the lower area of the float in which sand which passes through the filter 36 would likely settle during the time the valve is closed, thus minimizing the possibility of sand plugging. The filter 36 as described above provides an improved screening device which significantly increases protection to the entry of very fine grain sand within the injector and minimizes a likelihood of plugging, while also serving to break up foams in the wellbore to enhance the flow of liquids into the injector. The combination of the filter screen 36 and the repositioning of the injector shutoff valve 19 as shown in FIG. 2 thus significantly improves the operation of the injector.

Liquid Reservoir Above Packer

Figure 3:
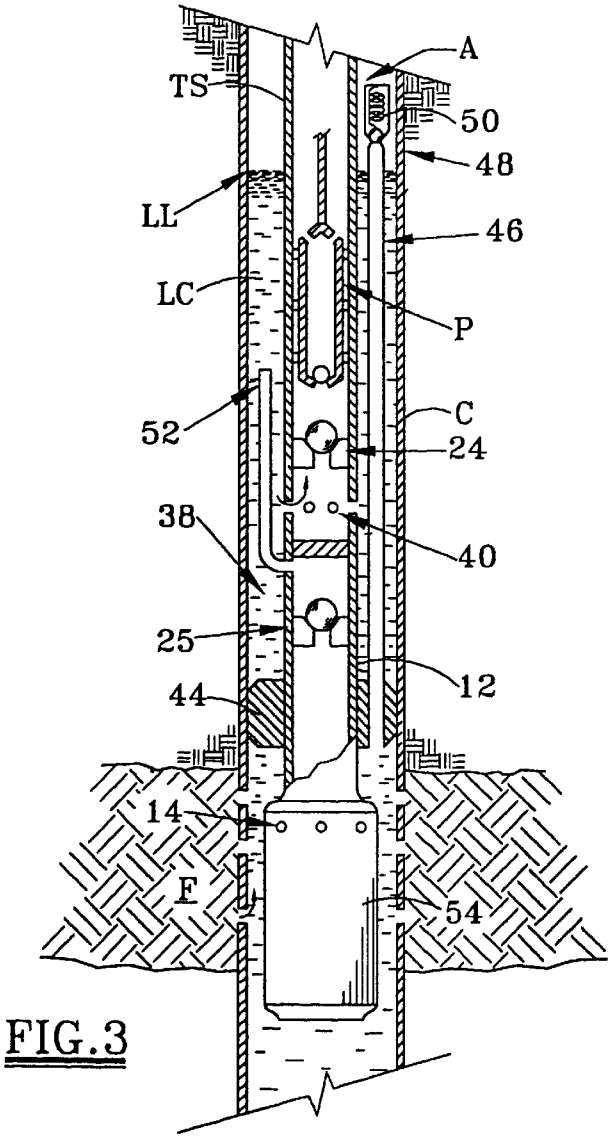
FIG. 3 illustrates an injector according to the present invention incorporating a packer below a liquid reservoir and a gas vent tube and a spring loaded check valve positioned above the working liquid level.

FIG. 3 depicts another arrangement of a liquid injector 54 according to the present invention. The components of the injector 54 are not being depicted in FIG. 3 since it may be understood that those components may conform to the previously described embodiments. The outer housing 12 of the injector 54 includes a plurality of openings 14 which allow fluids to enter the interior of the injector from the annulus radially outward of the injector. The basic operation of the injector 54 is as previously described.

For the embodiment as shown in FIG. 3, a downhole packer 44 is provided between the injector 54 and the casing C. A gas vent tube 46 sealingly passes through the packer 44 and extends upward to above the working level of the liquid LL within the casing C, as shown in FIG. 3. It should be understood that the annulus A between the tubular string TS and the casing C above the liquid level LL is occupied by gas, while the annulus below the liquid level LL as shown in FIG. 3 is filled with liquid. A spring loaded check valve 48 is provided at the upper end of the gas vent tube 46 and within the gaseous portion of the annulus. The spring loaded check valve 48 ensures that the pressure in the wellbore remains adequate to lift liquid in the annulus A well above tubing inlet ports 40. This gas vent system thus provides a gas venting and production system and maintains an adequate lift for the working fluid level to prevent the pump P from operating against a closed valve as more fully explained below.

In an artificial lift system utilizing a downhole pump P and an injector 54, the intake to the pump P is positively closed when the float shutoff valve closes. Unless the pump is programmed by downhole detection or surface energy output measuring devices to shut off, the pump operation will continue against the closed valve and thus waste energy. Also when the shutoff valve opens, liquid is forced into the depressurized flow tube 16 and this jetting action may induce vaporization. Operating against the closed injector valve, the pumping system inefficiently raises and lowers the entire volume of fluid within the tubing on each pump upstroke and downstroke. Moreover, each upstroke produces a vacuum below the standing valve which adds an additional pump load. When the separator shutoff valve opens while the volume below the standing valve is at a reduced pressure, liquid would be jetted through the separator shutoff valve and may be depressurized such that gas in solution with the crude oil may expand to flash and separate. Such a flashing could cause several undesirable consequences, including cooling and thus the creation of paraffins or solids participation, or the creation of a gas volume within the pump chamber which would prevent 100% liquid fill up and thus reduce the efficiency of the pump. These same problems would occur with other types of artificial lift pumping systems, such as electric submersible pumps or hydraulic positive displacement pumps.

The system as shown in FIG. 3 prevents pumping against a closed shutoff valve by providing a packer 44 to seal the annulus between the tubing string TS and the casing C above the liquid injector, and providing openings 40 from the annulus between the tubing and the casing above the packer but below the pump intake. Liquids from the formation thus flow into the interior of the injector housing and upward past the packer 44, and then through a check valve 25. This annular liquid chamber LC thus forms a vertical reservoir from which the pump P may draw fluid. As shown in FIG. 3, the injector 54 in the improved embodiment eliminates the above-described problems for prior art separators by providing a reservoir of liquid such that the pump intake is not directly supplied only by fluid passing at that moment through the injector shutoff valve, but also by liquid in the reservoir which flows through the annulus openings 40. The injector 54 and the pump P may thus operate independently in response to the liquid reservoir, and may operate continuously or intermittently as dictated by the producing formation and the injector and pump interaction. The pump P thus preferably will operate as dictated by the level of liquid in this vertical reservoir. A significant advantage of this concept is that the pump operation may be monitored and controlled from the surface such that it need not be operated when it does not have a sufficient liquid supply to the pump intake. Nevertheless, while the pump is inactive, the formation may continue to produce from the reservoir and through the injector. Any formation liquids produced from the reservoir are thus captured and easily recovered when the pump is subsequently activated. By adjusting the pump speed to maintain a working liquid level LL above the pump intake, optimum gas production is assured while short shut-in periods and repeated actuation of the injector valves are smoothed out. Longer term loss of fluid intake may be handled by timed or sensed pump-off controls while production would continue into the reservoir while the pump was shut off.

The vertical liquid reservoir as shown in FIG. 3 is thus created in the annulus between the tubing and casing and above the packer or other seal 44. The packer 44 in turn is positioned above the injector shutoff valve. The openings 40 above the packer 44 establish communication between (a) the interior chamber axially positioned between the standing valve 24 and the packer 44, and (b) the surrounding annular vertical reservoir axially between the packer 44 and the liquid level LL. These openings 40 thus allow fluid access between the reservoir to both the standing valve and the pump intake. As long as liquid production from the producing formation equals or exceeds the volume of the pump output to the surface, the system as shown in FIG. 3 operates at maximum efficiency. Should the injector liquid output exceed the pump output, the liquid level within the annular reservoir would rise. This fluid level rise would continue until the hydrostatic pressure of the liquid at the injector valve level equaled the producing formation pressure available to move the liquid out of the injector. In effect, the liquid reservoir above the packer thus lets formation pressure move liquid independently of pump output so that the pump may be stopped when liquid level drops while the formation keeps producing.

It should be understood that the system as shown in FIG. 3 permits two controls from the surface to more efficiently control the downhole fluid producing system. Because the annular reservoir above the packer 44 allows continual liquid production from the formation independent of the pump, the downhole pump may be stopped when it does not have liquid to supply its intake. A suitable control mechanism for stopping the pump may be a flow/no-flow detector in the surface flow line, or other conventional detectors which monitor pump load electronically. Once the pump is stopped, it may be programmed to restart automatically after a specified time period, during which liquid is again building in the annular reservoir. The system as shown in FIG. 3 assures optimum hydrocarbon production by adjusting the pump speed to maintain the working fluid level above the pump intake. A suitable pump-off control permits longer term pump operation and, most importantly, production from the reservoir through the wellbore continues when the pump shuts off. As with conventional artificial lift operations, it would be a desirable design for the pump capacity to closely match formation liquid production.

The second surface control is obtained by monitoring and controlling the gas pressure in the annulus A. If no gas is bled from the annulus at the surface, no gas may be produced by the system described herein. The formation to wellbore pressure differential necessary to move liquid through the formation may thus be achieved solely by liquid removal via the wellbore. Depending on particular formation and fluid properties and the producing fluid drive mechanism in effect within the producing formation, however, some gas may be bled off at the surface to optimize production or to relieve the buildup. This may be achieved by using available back pressure control devices which may bleed the desired volume of gas into a well surface flow line or into a surface located liquid/gas separator unit. The vent tube 46 as shown in FIG. 3 thus allows gas to move from the formation into an annulus between the tubing and the casing. The tube 46 functions to convey gas through the annular liquid reservoir so that it does not bubble up through the liquid and thus become entrapped or go into solution in the crude and enter the suction of a pump. A method of passing gas from the below the packer 44 to the upper portion of the annulus is desirably obtained without gas contacting the liquid in the annular reservoir. The length of the tube 46 would thus be designed so that it extends above the expected height of the liquid in the annulus at its maximum working level. The check valve 48 prevents liquid from reentering the tube 46 and flowing to the formation. The back-pressure control mechanism described above may be simplistically obtained by providing a spring 50 for holding the valve 48 closed. Valve 48 thus effectively acts as a back-pressure device to ensure that there will always be a higher level of gas pressure in the formation to drive liquid to the injector and upward through the annular reservoir, independent of the pressure of gas in the annulus. For example, if the chosen spring loading on the valve 48 required 200 psi differential to open, even if the annulus pressure were bled to atmosphere at the surface, a 200 psi formation pressure would be available to lift liquid to the annular reservoir. Should a surface valve in communication with the annulus be closed, the valve 48 would still maintain formation pressure at a higher level and liquid would be transferred upward until the liquid level build up equaled reservoir pressure in the wellbore.

The system as shown in FIG. 3 thus provides a method of creating a reservoir of liquid to more efficiently supply the pump P. Liquid may be continuously transferred from the injector to the liquid reservoir and from the liquid reservoir to the pump by the appropriate openings 40. This method also assures that a pressure differential is available to provide formation energy to lift liquid into the annular reservoir. By providing the back-pressure feature as discussed above, the optimum pressure differential around the wellbore may be obtained for maximum formation fluid movement and hydrocarbon recovery. This system achieves these objectives while eliminating or minimizing the production of natural gas and maintaining its valuable contribution as an energy source to efficiently deplete the oil zone within the downhole formation. In many isolated locations where liquid hydrocarbons are produced but wherein a gas pipeline is not accessible, gas would otherwise have to be flared and thus wasted. The system of the present invention allows for the production of oil while avoiding these flaring problems and also maximizes the production of liquid hydrocarbons from the formation.

The injector according to the present invention may also be used with an improved gas pumping power unit, such as that disclosed in U.S. Pat. No. 3,971,213 hereby incorporated by reference. The pumping unit as disclosed in the '213 patent describes a sucker rod pumping unit that may be powered by natural gas drawn from the annulus between the tubing and the casing of a well. This gas pressure, which need only be a minimal amount of gas above a flow-line pressure, may be used to power a piston which in turn actuates the beam of a pumping unit. The advantages obtained by this system include operation of the pump with a low incremental pressure while allowing the return of used gas to a sales line, and also counterbalancing of the system with pressure energy stored in the hollow substructure of the unit. The pumping unit as described in the '213 patent may thus be used in conjunction with the downhole injector as disclosed herein to create a producing system that may operate at minimum cost, and without the expense and maintenance of an electrical gas powered motor drive unit at the surface.

Another modification to the system shown in FIG. 3 will be to provide another check valve 25 above the packer 44, and one or more tubes 52, open to the tubing TS directly below a disk or plug in the tubing below ports 40, which provide fluid communication from above the check valve to the annulus above the packer. Any gas in solution which does enter the interior of the injector may thus pass through the check valve 25 and then the discharge tube 52 to move upward to the working fluid level rather than passing through the standing valve and to the pump. Gas is then discharged into the chamber below the liquid level LL but above the ports 40, so that the gas migrates upward to the liquid level LL and into the gaseous annulus above that level. Liquid, on the other hand, enters the pump P from the annulus at a position below the discharge from the one or more tubes 52, so that little if any gas flows from the annulus into the pump during its operation.

In another embodiment of this fluid reversal concept and which serves the purpose of tubes 52, the check valve 25 may be located below injector head 34 within a short sub essentially having the diameter of tubing TS. This sub with check valve 25 would be directly connected to tube 16. Above head 34, another tubing sub of a length of at least 6 to 10 feet would contain a vertical divider which creates two flow passages: one closed at the top to the production tubing string and ported to the annulus at its topmost location and open at the bottom to the flow from injector 54, and the other closed at the bottom to the flow from the injector 54 and having ports open to the annulus at the bottom and open at the top to standing valve 24.

Efficient Gas Production

It should also be understood that gas production from the reservoir may also be allowed according to this invention. Tube 46 through the packer 44 as shown in FIG. 3 extends to above the expected liquid level LL to allow for gas flow. The check valve 48 at the top of the tube 46 prevents liquid reentry below the packer. By applying back pressure control on the vent tube 46 via a spring mechanism 50, a lower annulus pressure above the liquid may be maintained to create a pressure differential for the desired liquid level and fluid flow, as well as a controlled relief of reservoir gas from formation F and below the packer 44 to above the liquid level LL and to the annulus A between the tubing and the casing. Various other fluid reentry and reversal mechanisms not shown in FIG. 3 may also be used in conjunction with the vent tube 46.

Moreover, the system as shown in FIG. 3 may be used in dewatering applications for gas wells. As previously noted, providing a reservoir above packer 44 lets formation pressure move liquid independently of pump output. The pump P may thus be stopped when liquid level drops, while the formation keeps producing. This particular configuration also provides a method of desirably pumping liquid accumulations off of a gas well and thus increase gas production. The liquid may be condensate (a liquid gas), or may be condensate combined with water. In the case of condensate accumulation, the liquid reservoir provides a superior method of pumping compared to prior art techniques. As discussed above, vaporization leads directly to gas locking problems for the pumping operation (both in oil wells and gas wells with condensate and/or oil). The technique of this invention desirably avoids vaporization and reduces pumping inefficiency. As for water accumulation, water may accumulate in the vertical reservoir above the packers 44 and be efficiently pumped off rather than build up around the perforations of the gas producing formation where the water may cause an undesirable spray-type disturbance in the well annulus. The injector as shown in FIG. 3 may also be used in conjunction with horizontal wells as described subsequently to obtain and enhance recovery and improve reservoir performance. The system of this invention is also more accommodating to gravel packed wells since it reduces fluid inflow velocity and wellbore damage.

Improved Reservoir Performance

By improving the features and operation of the injector as described above, significant benefits may be obtained by retaining in situ formation natural gas or injected gas within the reservoir to effect increased recovery of liquid hydrocarbons. Rather than use the natural gas energy to immediately produce high quantities of hydrocarbons and thus deplete the formation, the concept of the present invention retains the energy of the natural gas as a driving fluid to achieve desirable initial liquid hydrocarbon flow rates and significantly higher long-term liquid hydrocarbon flow rates compared to prior art techniques, without damaging the reservoir. The basic concept of the method according to the present invention may be shown with respect to FIG. 4, which depicts an idealized vertically thick reservoir with the oil bearing formation F having a good continuous vertical permeability, and with either initial gas cap GC or highly saturated crude above the formation that forms a secondary gas cap with pressure reduction. According to conventional practice, the lower part of the formation would be open to the reservoir and hydrocarbons would be produced at the highest rate possible along with the gas. This action would quickly deplete the near wellbore liquid zone as the gas would tend to cone towards the pressure depleted zone, driving oil into the well. This conventional coning would result in a gas to liquid interface as shown in dashed lines in FIG. 4. This coning is highly undesirable since it significantly reduces the ultimate oil recovery and prematurely depletes the gas reserve. Coning is thus avoided or at least minimized according to the techniques of the present invention.

Figure 4:
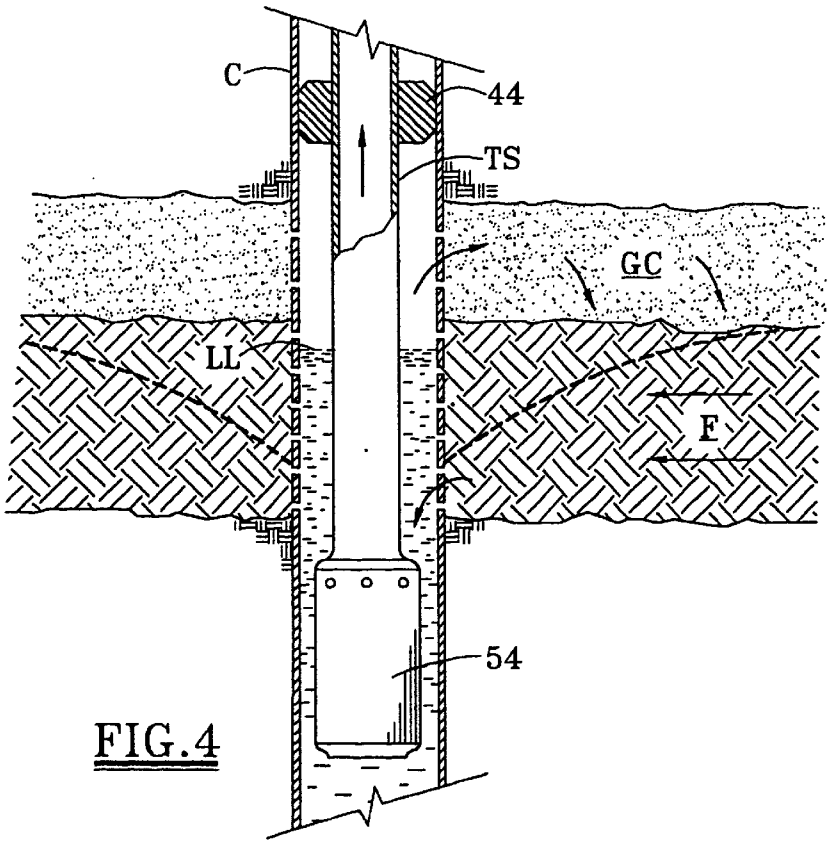
FIG. 4 illustrates schematically the improved hydrocarbon recovery performance provided by the liquid injector of the present invention.

As shown in FIG. 4, a packer 44 is provided in the annulus between the casing C and the production tubing string TS. The casing above the formation F, including the gas zone, is also perforated. Gas in the wellbore below the packer 44 and above the liquid level LL returns to aid the gas cap, and is kept out of the tubing string TS by the injector 54. According to the present invention, gas is refused entry into the wellbore due to the operation of the injector 54 (which may have the features of the injectors previously described), and thus gas may stay within the reservoir. This scenario forces the reservoir to maintain a substantially horizontal interface between the liquid hydrocarbons in the formation F and the gas cap GC, which acts on the liquid from the top down and tends to aid gravity drainage of the liquid down and then laterally into the wellbore.

It should be apparent to those skilled in the art that not all reservoirs will respond to this forced gas drive mechanism as described above. Liquid producing rates would likely be lower initially as the gas drive acceleration and natural gas lift is eliminated. By forcing the return of gas from the top of the wellbore back into the gas cap within the same well, optimum resistance-free completions and pressure differentials adequate to drive the gas back into the formation will be required. This desired pressure differential may be generated by pressure below the packer 44 and in the gas zone GC reflecting the higher pressure at the bottom of a liquid column in and near the injector 54, wherein said higher pressure results from the hydrostatic head of liquid in a relatively thick formation. It will be described later how the return of produced gas in the wellbore may be accomplished or aided by other mechanical means.

A pressure differential from the we ilbore to the formation may be created in the upper part of the gas column within the wellbore by the rising liquid column which builds after the injector closes to shut in the gas. That pressure differential will try to displace gas back to the formation, although that pressure differential is typically quite small and, except for applications with thick reservoirs of several hundred feet or more, the formation may not be sufficiently permeable for gas to go back into the reservoir. A small pressure differential may thus not effectively prevent continued gas build up in the wellbore. The liquid/gas interface may thus move relatively quickly downward to the injector intake, while the interface would likely rise very slowly to cause only intermittent opening of the injector. Reservoir studies may be necessary in some applications to define the requirements and physical characteristics of reservoirs that will be conducive to the improved performance according to the present invention, and to analyze the relative economics of the present invention compared to conventional hydrocarbon exploration and recovery techniques. Many reservoirs should, however, benefit from the concepts of the present invention and will result in significantly improved performance.

Figure 5:
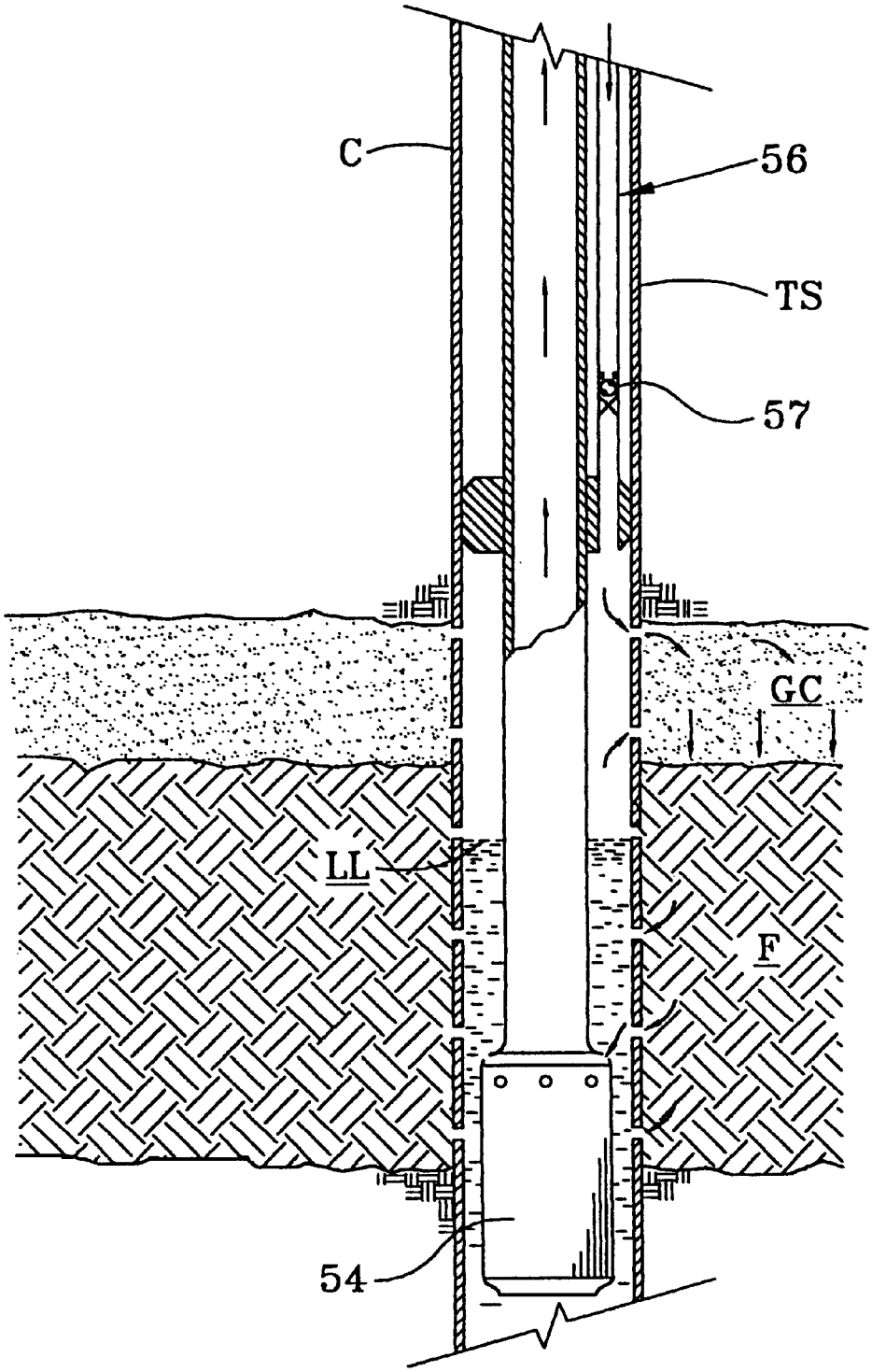
FIG. 5 illustrates the use of an injector in an application for improving recovery of hydrocarbons from substantially depleted zones.

The concepts of the present invention may also be extended to applicable reservoir situations for secondary and tertiary recovery by maintaining gas in the reservoir according to the present invention and then adding gas with a conventional secondary or tertiary injection operation. Thus the concepts of the present invention and the maintenance of the formation gases when combined with injected gases, such as carbon dioxide, nitrogen, natural gas or steam, may further assist in recovery of hydrocarbons. Applicable gas driving mechanism may thus be initiated or enhanced in older reservoirs in which the natural gas has been substantially depleted. The injector of the present invention will, of course, also tend to maintain any injected gas in the formation rather than recovering the ejected gas to the surface and then again reinjecting the gas. FIG. 5 depicts a secondary or tertiary recovery operation with an injector 54 in the lower part of a wellbore. A gas injection string 56 extends from the surface downhole through the packer 44 to supply pressurized gas to the gas cap GC. A check valve 57 optionally may be provided at the lower end of the injection line 56, and possibly within the packer 44, to prevent fluid from flowing upward past the packer through the injection line 56. Conventional compressors (if needed) would typically be provided at the surface for this gas injection operation. FIG. 5 thus depicts gas supplying the cap GC both from the lower part of the wellbore where gas is prohibited from entering the tubing string TS by the injector 54, and from the gas above the liquid level LL which is input to the wellbore and to the gas cap GC by injection string 56. It should be understood that such gas injection could also occur through a separate well as is the case in many gas re-injection, re-pressuring projects, or gas storage reservoirs. The pump P as previously described is not shown in FIGS. 4 and 5, but in many applications a downhole pump will be provided above the injector 54 for pumping fluids to the surface through the production tubing string TS.

Liquid hydrocarbons may thus be recovered according to the present invention from an underground formation without producing natural gas with the liquid hydrocarbons. By positioning the injector as described above downhole in the wellbore adjacent to the producing formation, the pressure energy of the gas will be maintained to flow the liquid hydrocarbons into a producing tubular string and then to the surface. Such a system may have sufficient gas pressure to lift or flow a column of liquid to the surface without the use of an artificial lift system, so that the system comprises only a production tubing string and a downhole injector. The injector may be open to the producing formation and operated within the casing string for retaining gas in the formation. The entire annular area between the tubing and the casing may thus be exposed to formation fluids at essentially formation pressure. The flowing bottom hole pressure of gas and liquid at the intake to the injector may thus be the energy sufficient to move liquids through the injector and through the production tubing string to the surface.

Flowing oil wells are commonly assisted by the incorporation of gas in the liquid column, either as slugs from the formation or as gas breakout through pressure production as the liquid rises within the tubing. Such gas incorporation reduces the average density of the flowing fluid and thereby requires less fluid pressure energy to lift the hydrocarbons to the surface. Separating gas at the bottom of the wellbore by the injector according to this invention may thus increase the average density of the flowing fluid and may thus require a higher pressure to lift the fluid.

In open annulus wells as described above, the injector may separate liquid from gas within the wellbore and flow liquids to the surface while also providing gas formation pressure exceeding the hydrostatic head of the fluid column, plus the flow line back pressure. Such configuration is not common because it is generally not desired to expose the annulus and thus expose the casing itself to higher formation pressures. Thus wells with formation pressures high enough to flow, and particularly deeper wells, are generally equipped with a packer or sealing device located at the bottom of the tubing string to seal the annulus between the casing and the tubing and thereby isolate formation pressure from below the packer and within the tubing string. The annular volume in deep, high pressure wells may be substantially filled with brine or another heavier-than-water liquid containing a corrosion inhibitor. Such fluids and attended monitoring schemes assure that high pressure does not leak into the annulus. In wells with a packer which seals with the annulus, the injector according to the present invention may still be used to separate liquid and gas and thus conserve the gas and its associated energy within the casing. FIG. 4 thus illustrates this concept, with the injector located below the packer. The vent tube 46 as discussed above need not be provided for the embodiment shown in FIG. 4. The gas energy may still be used to flow the liquid hydrocarbons to the surface.

The injector of the present invention may thus be used adjacent to a producing formation and in a flowing well to avoid producing natural gas. By providing the injector 54 below a packer 44 in high pressure wells, the annulus between the tubing and the casing may be sealed from formation pressure. The injector 54 below the packer may also be used in a well produced by an artificial lift system, wherein the artificial lift method is a closed loop gas lift operated with minimum need for supplemental gas from the formation. The injector of the present invention may thus be used in numerous applications where gas production is undesired, wasteful, or prohibited.

Figure 6:
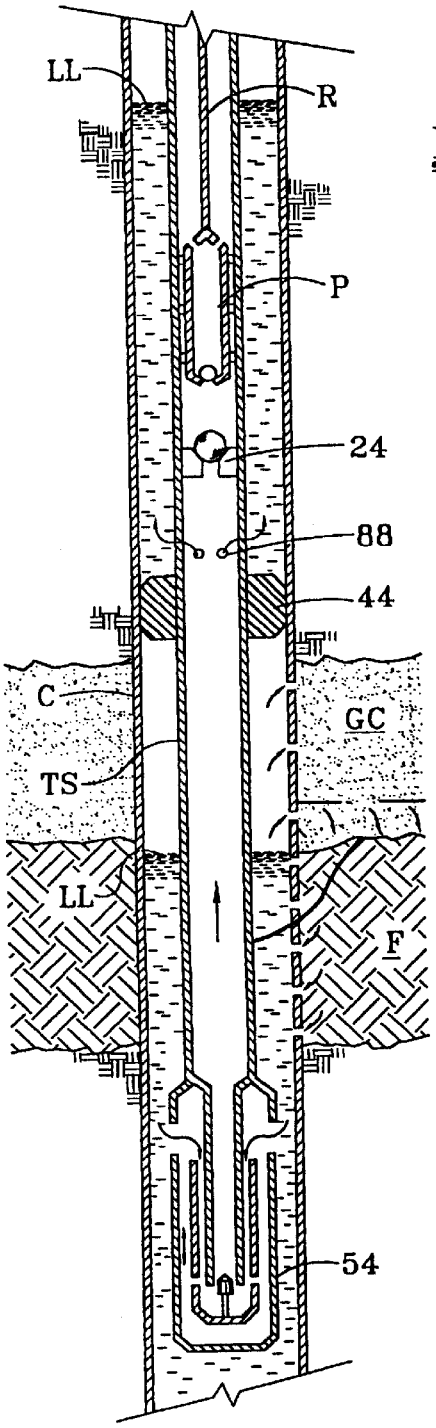
FIG. 6 illustrates schematically improvements in gravity drainage provided by the liquid injector of the present invention and a liquid reservoir above a packer.

FIG. 6 illustrates another application using the injector 54 of this invention. In this application, a thick reservoir includes a lower oil bearing formation F and an upper gas cap GC. The injector 52 is suspended in the well from a production tubing string TS. A packer 44 is provided to seal the annulus between the tubing string TS and the casing C at a position above the gas cap GC. The injector 54 prevents entry of gas into the tubing string so that gas moves upward in the gnnulus to rise above the liquid level LL and reenters the formation. The gas cap moves downward from the interface shown in dashed lines to the interface shown in solid lines, and thereby moves the liquid down and toward the well without coning. Crossover ports 88 in the tubing string TS above the packer 44 allow communication back to the annulus. Standing valve 24 is provided above the crossover ports 88, and the pump P powered by rod string R is then provided above the standing valve. The annulus above the packer 44 thus obtains a working flow level for efficient operation of the pump P, as previously described.

The above-described systems, in conjunction with the injector 54, allow the formation to produce sufficiently without gas breakthrough or coning, yet utilizes formation gas to assist in the flowing and/or artificial lift at the well. This downhole system may allow for the bleed off of a controlled amount of formation gas entrapped by the producing system to allow the efficient production of liquids from the formation, as will be described. The downhole system may also maintain an optimum predetermined pressure differential between the wellbore and the formation. As noted above, a packer may be used in many applications, but need not always be provided. Formation gas may thus be effectively utilized to help lift liquids from the well in a manner which uses the advantages of producing a well with a downhole injector but permits only liquid production through the injector.

Figure 7:
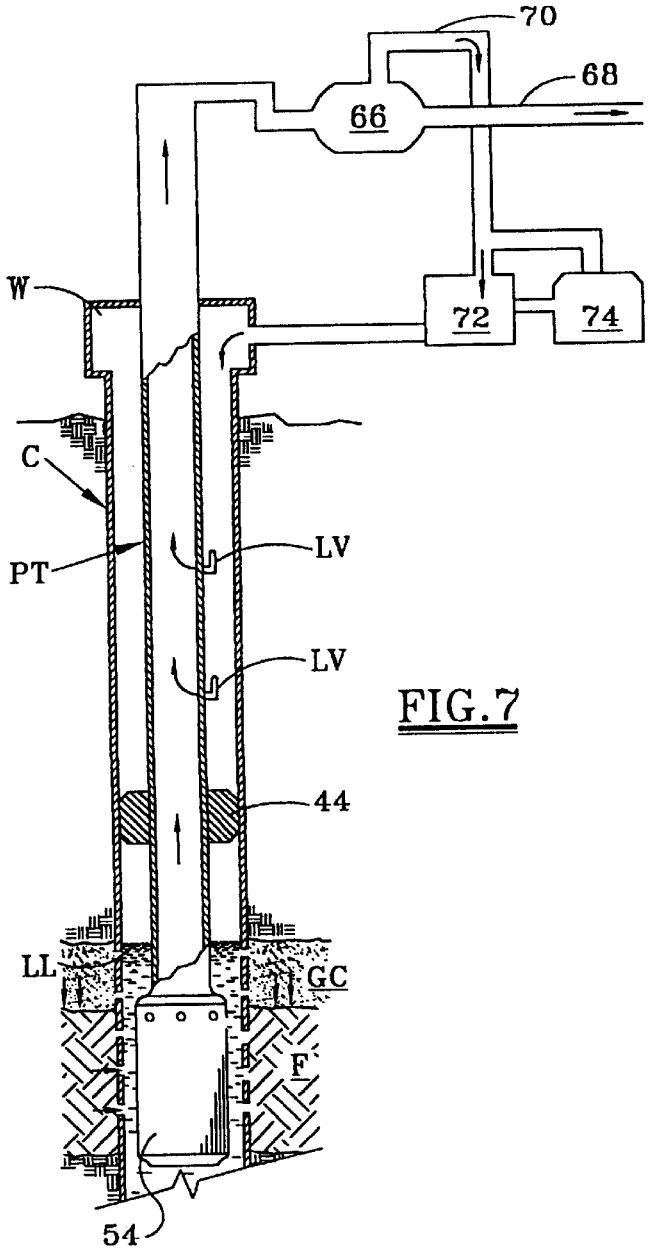
FIG. 7 illustrates an application of a liquid injector used in a flowing well with gas lift.

A variation of the above described embodiment incorporates gas lift with a packer 44 in the annulus between the tubing and the casing, as shown in FIG. 7. This system utilizes gas lift valves LV positioned along the tubing string TS and above the packer to help produce liquid from the liquid injector to the surface. The surface equipment depicted in FIG. 7 includes a surface liquid/gas separator unit 66 with a liquid hydrocarbon flow line 68 extending therefrom. Gas from the separator 66 may flow via line 70 to compressor 72, which in turn is powered by gas engine 74. The pressurized gas is then circulated in a direct loop, and may be discharged back into the well to act on the lift valves LV and help bring the liquid hydrocarbon to the surface. A further explanation of the lift valves LV is discussed below.

Figure 8:
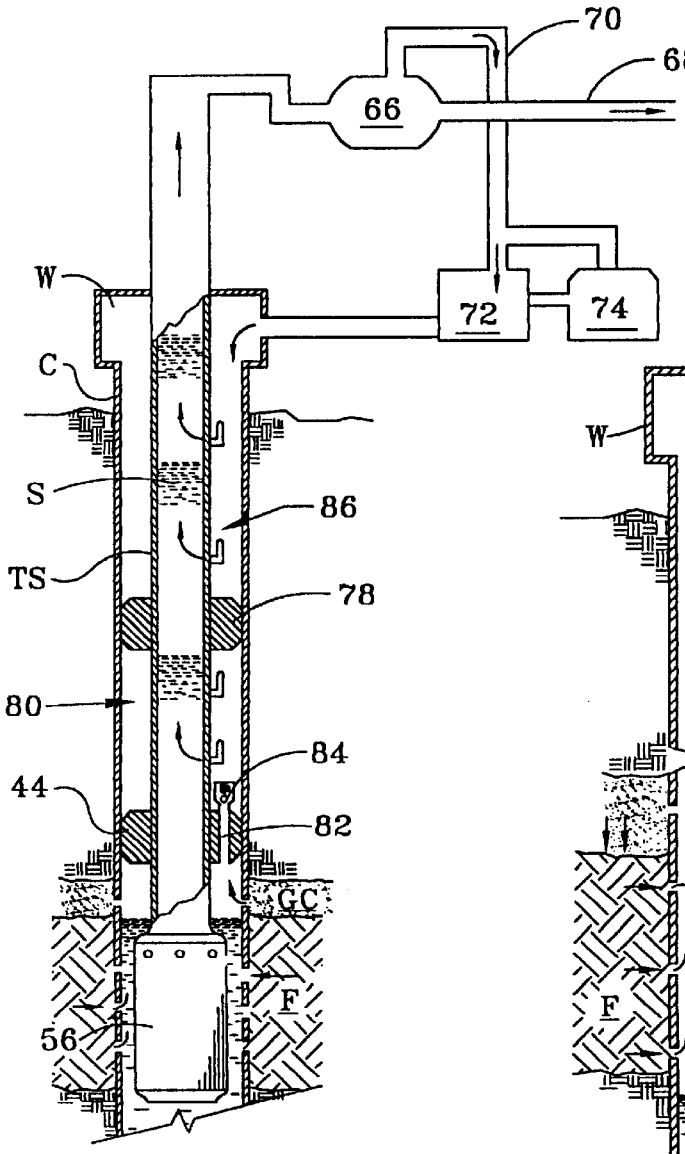
FIG. 8 illustrates an application wherein a liquid injector is used in combination with chamber gas lift with a bleed-off control.

The system as shown in FIG. 8 uses a lower packer 44 and an upper packer 78 to create a chamber 80 in the annulus between the tubing and the casing. This chamber may be fluidly connected to the wellbore below the lower packer 44, which is open to the formation F, by a vent line 82. As shown in FIG. 8, the lower packer 44 thus incorporates a tube 82 with a check valve 84 at its upper end. This tube 82 allows the release of formation gas to the chamber 80, so that gas pressure builds up above the lower packer 44. The check valve 84 prevents communication from the chamber 80 back to the formation and closes the chamber 80 so that a gas charge may be built up for the gas lift process. Within the chamber 80, one or more lift valves LV may sense and maintain pressure in the chamber 80 at a level sufficient to create the desired differential from the reservoir to the wellbore. Accordingly, when pressure builds above this level, formation gas is discharged from the chamber 80 to the tubing and thus to the surface. Additional lift valves in the chamber may sense the level of liquids rising in the tubing and open to lift the liquid upward to an upper gas lift valve.

A significant advantage of the system as shown in FIG. 8 is that gas production may be controlled and utilized for lifting purposes, but no free gas is allowed to flow into the open tubular through the injector 54. The gas lift valves LV allow for such pressure control in the lower chamber 80 and sensing of fluid slugs S in the tubing string TS. Conventional gas lift technology is thus combined with the injector 54 of the present invention to permit only the flow of liquids from the reservoir and retain gas cap pressure to enhance gravity flow. Moreover, the system as shown in FIG. 8 provides for the controlled bleed off of gas pressure under the lower packer 44 within the wellbore and directly utilizes that bled off gas to help the lift valves 86 to produce the desired liquid from the tubing string.

Two gas lift valves are shown within the chamber 80, but those skilled in the art will realize that additional gas valves may be desired or necessary for additional volume. The upper valve, which is commonly known as a casing pressure operated valve, will typically be set by internal bellows precharging to a known pressure and will thus act as a regulator. This will ensure that pressure in the chamber 80 and the corresponding wellbore pressure will never exceed the desired wellbore pressure limit selected by the productivity index analysis for optimum reservoir fluid inflow. This upper regulator valve will thus open and discharge gas into the tubing when chamber pressure exceeds its predetermined setting. Gas discharged into the tubing will aid in lifting any liquid within the tubing to the surface. The lower lift valve, which is the tubing pressure controlled valve, is designed to open at a preselected internal tubing pressure reached by the increasing column of liquid above this valve. When the injector allows sufficient inflow, the lower gas lift valve opens, then gas buildup in the chamber 80 suddenly flows under the liquid slug, lifting the liquid farther up the tubing string. These gas lift valves are also commonly referred to as intermitting valves.

The combination of injector and gas lift valves as described above may also be incorporated into an artificial lift system in which the primary lift mechanism is the closed system operating with gas lift valves above the upper packer. In operation, liquid slugs may be partially lifted by the relief formation gas coming from the lower chamber to be picked up by the main gas lift system 86 above the upper packer 78, so that the liquid slug is carried to the surface. Accordingly, the formation F and chamber 80 may be maintained at a pressure of, e.g., 1,000 psi, or approximately 500 psi below shut-in reservoir pressure. This 1,000 psi will be available to the lower chamber valve to assist in lifting liquid slugs when it is activated to do so. The main lift valves 86 may be responsive to annulus pressure above the upper packer 78, required to assist in driving the liquid slugs S to the well head W. Conventional liquid/gas separation, processing, and decompression mechanisms provided at the surface may extract the desired liquids and recycle the gas through the artificial lift system. The system components 66, 68, 70, 72 and 74 were previously described. Excess gas introduced from the formation and input to the tubing string from the lower relief chamber 80 may be partially utilized as fuel for the compressor prime mover 74, which reduces the gas produced by the well system. Reservoir and facility engineering calculations may be used to determine the estimated amount of formation gas to be utilized to achieve the desired well productivity. Site specific conditions will influence the design to properly utilize any excess produced gas, whether for sales line, minimal flaring or reinjection into another zone or well. By using known reservoir and gas life engineering techniques, the system of the present invention may be designed to maintain a desired pressure differential between the interior of the wellbore and the formation to create the desired reservoir fluid in flow.

Flowing Well Applications

As previously noted, the liquid injector of the present invention may be used in artificial lifted wells. By obtaining the significant advantages of retaining in situ gas within the reservoir, however, the liquid injector may contribute to liquid hydrocarbon recovery from a high pressure flowing well which will have sufficient bottom-hole pressure to lift a column of reasonably light fluid to the surface. In an isolated recovery location, systems for handling produced gas would thus not be necessary, thereby retaining the reservoir in an ideal condition. In one application, a high pressure well may have the annulus between the tubing and casing open to the reservoir. In another application, the downhole packer 44 as shown in FIG. 4 may be placed in the annulus between the tubing and the casing. If desired, the annulus above the packer 44 may be filled with a protective fluid, such as a drilling mud or a completion fluid.

Figure 9:
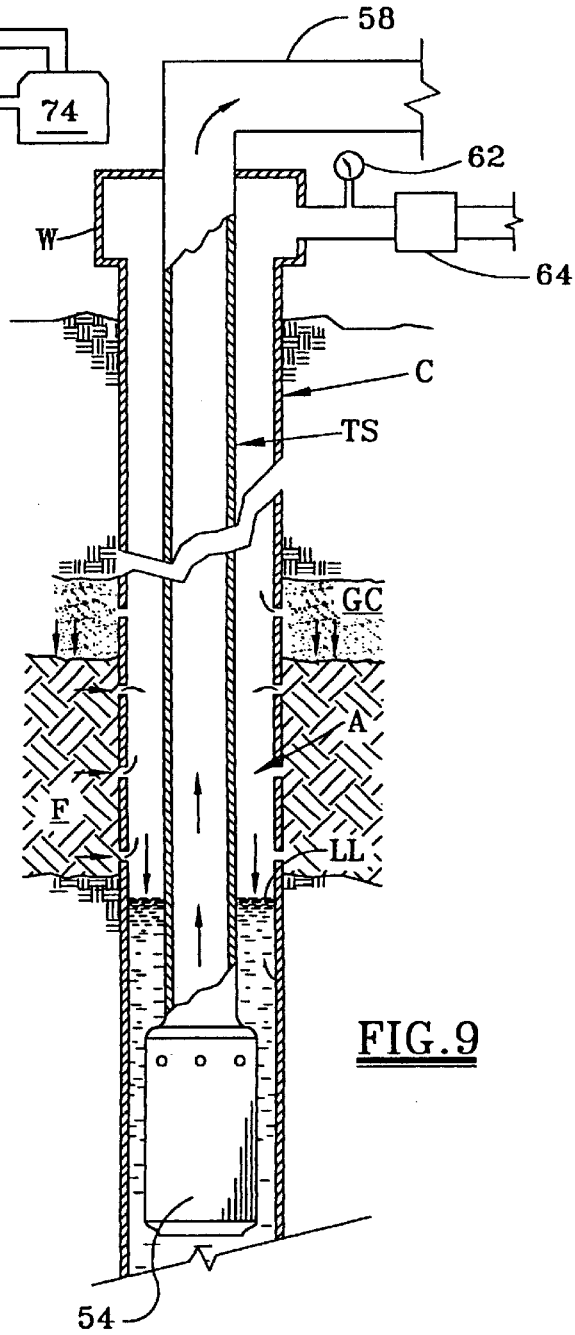
FIG. 9 illustrates the use of an injector according to the present invention in a free flowing well.

FIG. 9 depicts high pressure gas acting downward on the formation liquid through the gas cap GC and forcing the formation liquid into the injector 54. The system as shown in FIG. 9 has a high pressure in the formation to result in a free flowing well. Liquid hydrocarbons thus pass upward in the tubing string to the wellhead W at the sub surface without artificial lift. The system may thus be operated without a packer between the tubing and the casing, as shown in FIG. 9, for assisting in recovery from a flowing well which does not utilize artificial lift. Liquid hydrocarbons may thus flow out the line 58 from the wellhead W. Gas in the annulus A between the tubing string TS and the casing C may be maintained at a desired pressure by regulator 64 at the surface. This pressure may be monitored by gauge 62, and is ideally maintained at a safe yet sufficiently high level to maintain the well in a free flowing condition. Excess gas may be economically recovered through regulator 64.

Horizontal Well Applications

The techniques of the present invention are also applicable to horizontal wellbore technology, wherein one or more horizontal bore holes or laterals are drilled from and connected to a substantially vertical well. Horizontal well technology may provide a variety of downhole hydrocarbon recovery configurations. This technology has the significant advantage of creating a longer and more effective drainage system through the reservoir than conventional vertical well technology. The injector of the present invention may be applied in many of these applications to offer substantial advantages over conventional vertical well hydrocarbon recovery techniques.

A horizontal we ilbore is generally parallel to the formation and may thus be drilled and completed so as to be open to a producing formation over a relatively long distance. The horizontal wellbore or lateral thus has a much greater opportunity to collect reservoir fluids for production to the surface, and productivity for horizontal bore holes accordingly may be substantially increased over conventional vertical wells. Horizontal wellbore technology thus may recover a greater percentage of the oil and gas from reserves compared to conventional vertical wellbore technology. To accommodate the high volumes of fluid that may be produced by the horizontal bore holes or laterals, the vertical well with the injector therein should be large enough to accommodate sufficiently sized tools of the present invention and match the anticipated fluid production.

Figure 10:
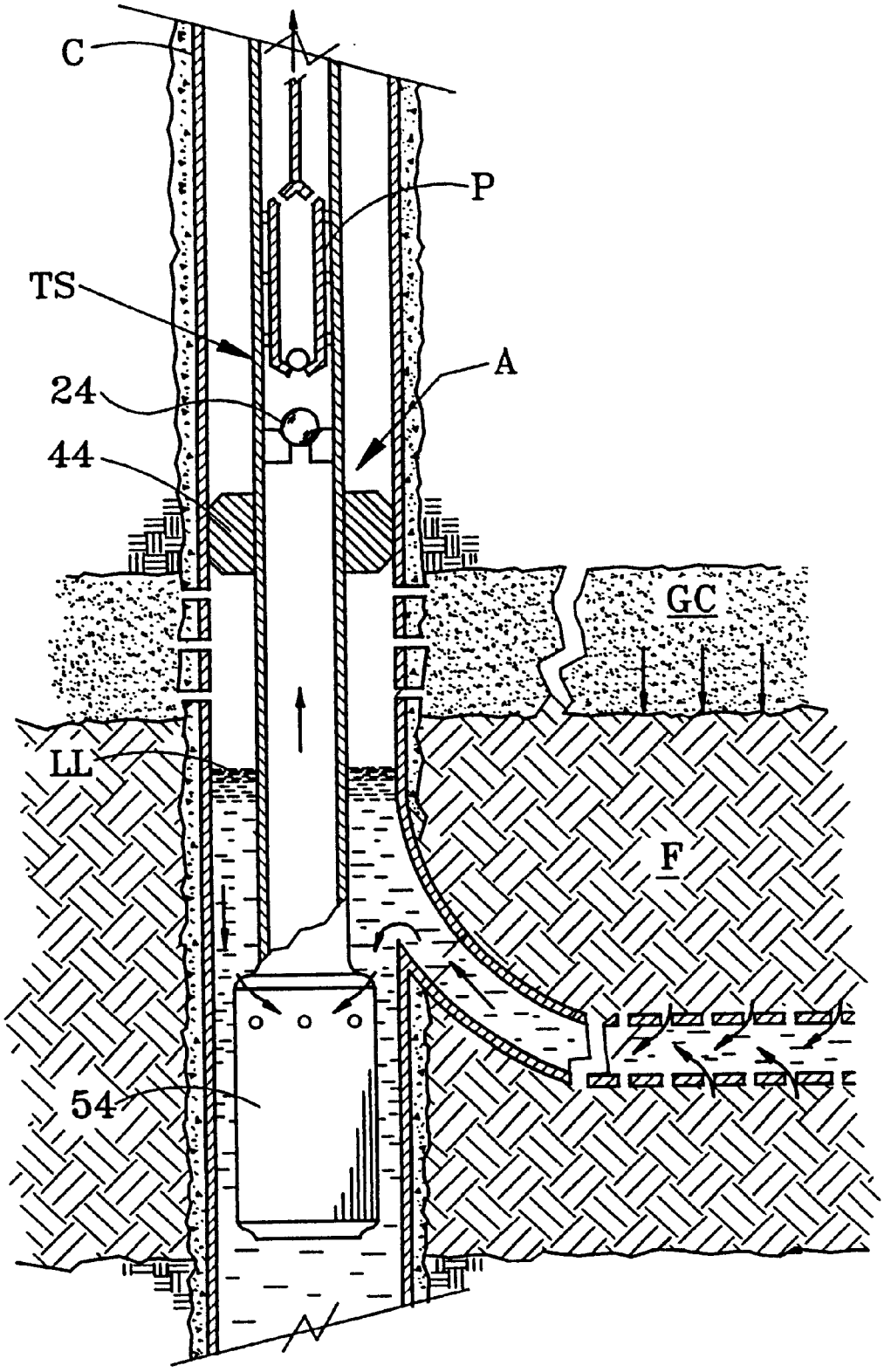
FIG. 10 illustrates an injector used for gas control in a horizontal well application.
Figure 11:
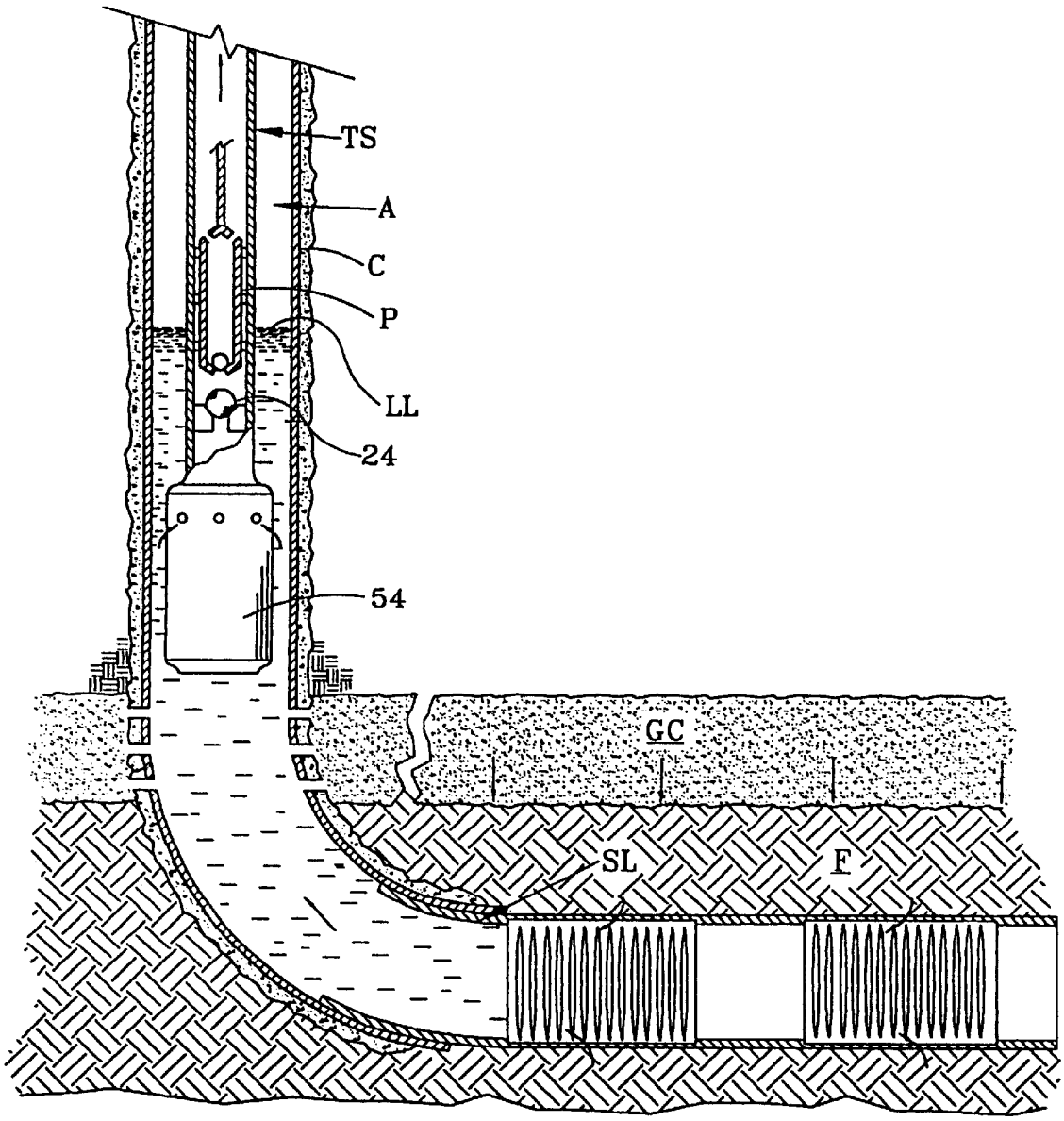
FIG. 11 illustrates the use of an injector in an alternate arrangement in a horizontal well application.
Figure 12:
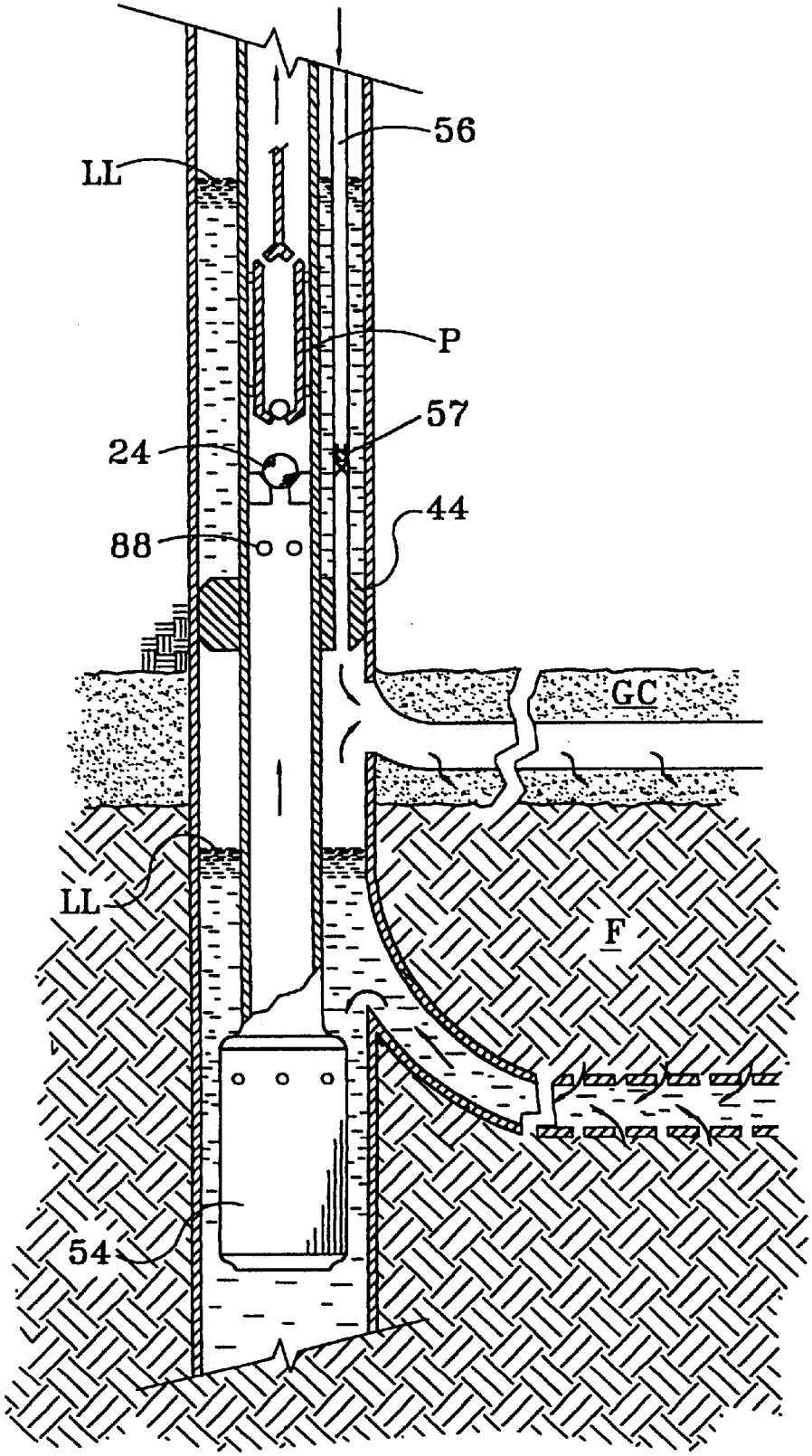
FIG. 12 illustrates another application wherein a liquid injector is used with horizontal bore hole technology for enhanced hydrocarbon recovery.

Various types of artificial lift systems may be used in conjunction with the injector and the horizontal we ilbore technology. Pressure within the annulus of the well may be controlled from the surface, as explained above, to control the producing bottom hole pressure in each of the one or more wellbores positioned within the producing zone. As previously noted, a packer may be used above the producing zone to isolate the annulus between the tubing and the casing for producing fluid, with the injector then being provided below the packer. A system with an injector may thus be reliably used for high pressure flow in horizontal well applications. The injector as described above utilizes a float concept such that the injector may be installed and operated in a near-vertical position. This limitation does not limit the use of this technology in horizontal well applications, however, as shown in FIGS. 10, 11 and 12. Moreover, a modified float system or a density sensor could be provided downhole for sensing the presence of liquids or gas, and the shutoff valve could be electrically, hydraulically or mechanically actuated in response to this modified float system or density sensor so that the injector operation need not be limited to a vertical or near-vertical orientation in the wellbore.

The liquid injector according to the present invention thus may be below or above the horizontal laterals and within the vertical portion of the well. The horizontal configuration of the producing wells as described above may be used to improve recovery by gravity drainage as previously described, and there are distinct advantages achieved by retaining gas energy within the formation in horizontal well applications. In FIG. 10, the horizontal well intersects the vertical well above the injector 54. The gas cap GC forces the oil downward for collection by the horizontal bore hole. Packer 44 serves its previously described purpose of preventing the gas from moving up in the well annulus, and thus assists in maintaining the desired gas cap GC. Accordingly, the casing C may be perforated in the zone of the gas cap GC and above the liquid level LL. Pump P drives the oil to the surface and, for this application, is preferably a high volume electric submersible pump P to pump large flow rates of oil through the tubing string TS. Conventional electric submersible pump configurations would require the addition of ports 40 and 88 as shown in FIGS. 3 and 6 to allow fluid flow past the pump motor for cooling.

As shown in FIG. 10, one or more horizontal laterals may be drilled from a substantially vertical wellbore within a single substantially horizontal plane. One or more horizontal laterals may thus each be initiated from a vertical hole by a pilot hole utilized to start the horizontal bore hole. A pilot bit may be used to cut a hole in the casing and start the horizontal lateral. The pilot bit may then be retrieved and a conventional drilling tool used to result in the horizontal bore hole. A retrievable whipstock may be used so that the kick off tools do not interfere with the subsequent placement of the injector in the bore hole. If a cement plug is positioned on the vertical portion of the bore hole, the plug may be drilled out after the horizontal bore holes are completed.

FIG. 11 illustrates a horizontal bore hole drilled in formation F below a gas cap GC as a continuation of the vertical boreholes. The oil enters through a screened liner SL, typically operating within a gravel-packed borehole. A variety of horizontal drilling technologies may be used with the concepts of the present invention. Both horizontal and highly angled holes extending from the existing wellbore may be used to increase the area of drainage. Conduits commonly referred to as drain holes may be configured as a variety of jet drilled perforations or larger boreholes, or short-radius drilled holes may also be used in conjunction with the injector of the present invention.

After drilling the laterals, the injector 54 may then be located within or above the producing formation and in the vertical portion of the wellbore. As shown in FIG. 11, the non-vertical wellbore lateral is provided below the injector 54 and will thus be open to the producing fluids. This configuration allows for the drilling and completion of the horizontal wellbore below the vertical section of the well. The wellbore may be completely cased or cemented down to at least the producing formation, thereby positively containing fluid within the formation. In wells requiring artificial lift, the injector and the intake to the pump P may be located at a level sufficiently low relative to the producing formation such that the available reservoir pressure in the formation may lift liquids to at least the level of the pump. The reservoir characteristics would thus determine the relative height at which the injector and pump would be set, which in turn would determine the horizontal drilling and completion characteristics. To locate injector 54 as close to the producing zone as possible will require use of existing shorter-radius horizontal drilling and completion techniques. The annulus A above the pump may be pressure controlled at the surface to monitor the desired liquid level LL. Liquid hydrocarbons from the pump P are thus produced to the surface through the production tubing string TS.

Another example of horizontal well technology is shown in FIG. 12, wherein a second layer of horizontal wellbores or laterals extend from the vertical wellbore which contains the injector 54. The upper wellbore lateral may be located within a gas zone and above the relatively thick liquid bearing formation F. The injector 54 acts to circulate separated gas back to the reservoir and return energy to the reservoir for driving oil from the formation rock. By retaining the gas in the formation and separating the gas downhole, expensive equipment and techniques involving the recovery of the gas energy and the subsequent reinjection of the gas back into the formation are thus avoided. It is understood that more than one wellbore may be extended laterally from the vertical wellbore in both the gas cap and the producing formation and in different directions to encompass a larger drainage area. This technique is commonly referred to as using multi-laterals.

By using the liquid injector of the present invention in conjunction with one or more laterals or otherwise substantially horizontal wellbore fluid conduits which extend a long distance into producing formation, the productivity from the well may be substantially enhanced. The injector may be used to freely transmit liquids into the production tubing string while preventing the entry of gas to the surface. By providing the injector at or near the level of the producing formation and within the essentially vertical bore hole which is open to one or more horizontal laterals, liquid production from one or more horizontal bore holes may significantly increase and free gas is provided back through the producing formation, optionally to one or more separate horizontal bores or conduits at a level higher within the formation. FIG. 12 thus discloses another possible advantage of using the horizontal well completion technology with a second bore hole positioned in the gas cap to facilitate gravity drainage by enhanced gas pressure in the gas cap. The enhanced gas cap maintained by the upper lateral in the upper part of the reservoir thus contributes to the production of the liquids from the lower lateral. By providing a packer in the well as shown in FIGS. 10 and 12, the techniques of the present invention may be self-sustaining by the forced return of gas to upper zones.

FIG. 12 illustrates how the injector 54 may be used in a vertical section of the well which has one or more horizontal bores each drilled from different levels. Combining an injector of the present invention with high productivity from lateral wells while also retaining the reservoir gas energy downhole is an effective approach to maximize hydrocarbon recovery. Various types of pumps such as an electric submersible pump may be used in combination with an injector to create an efficient and high-volume producing well. As shown in FIG. 12, a horizontal bore hole through an upper section may be used to convey injected gas deep into the reservoir for a more effective drive mechanism to the horizontal producing we ilbore. This system with upper and lower horizontal wellbores would circulate and retain gas which is prevented from moving into the tubing string by the injector and thus is maintained in the downhole formation. As previously disclosed, the gas pressure below the packer 44 may maintain a desired liquid level LL in the annulus above the packer, with the crossover ports 88 above the packer serving the purpose previously described.

A system similar to that shown in FIG. 12 provides for strongly enhanced recovery using secondary or tertiary recovery methods through which pressure depleted reservoirs could be made to produce at higher levels. Using two horizontal bore holes from different vertical wells, gas from the surface may also be used to assist the driving concept. The injection line 56 thus extends from the surface through the downhole packer 44 to assist in maintaining an effective gas cap GC. Check valve 57 optionally may be provided along line 56 to limit gas flow along line 56 to the downward direction. The concepts of the present invention may also be applicable to a version of "huff and puff" recovery technology in which gas is injected for a period of time then suspended while liquid buildup is produced. The gas zone for pressurizing could be injected from an offset well, preferably located structurally close to the recovery well.

In a dual packer embodiment used with horizontal technology, the tubing regulator mechanism may be used to control and trap gas relief from the wellbore into the chamber between the packers and thus provide the desired pressure differential from formation to wellbore, while the injector prevents free gas production. Gas in the chamber between the packers may further act as the first lifting stage for slugs of liquid entering the tubing. The injector of the present invention may thus substantially assist the productivity of horizontal wells by utilizing the free gas prevented from going into the tubing string by the injector to enhance liquid production. In an alternate embodiment, a packer is positioned in the wellbore between the upper gas injector laterals and the lower fluid recovery laterals.

Various other embodiments may be possible utilizing the injector of the present invention. The entire reservoir may be open to the wellbore, and the formation isolated only below the packer. Only liquid may be produced through the liquid injector and gas recirculated back to the gas zone. The gas may also be injected through the packer to replenish gas energy as previously described. Gas re-entry into the gas zone is facilitated by the use of horizontal lateral boreholes connected with the wellbore below the packer. The liquid injector of the present invention may thus be incorporated into existing or planned field gas injection programs to help control gas breakthrough.

A significant feature of the injector and packer configuration according to this invention, which is mentioned briefly above, is the reduced risk of a well blowout. Gas is not free to escape from a pump assisted well which includes the injector as disclosed herein. Only the small amount of gas above the packer, the oil above the pump and solution gas in liquids that do pass through the injector would be available fuel for any blowout. Accordingly, a well including the injector and the technology of this invention may be more easily controlled if a blowout does occur.

While the concepts of the present invention may work in various types of wells, retaining gas within the reservoir and recovering a high percentage of oils by gravity drainage is most effective for use in thicker reservoirs in which a cap gas or solution gas breakout is otherwise used as a mechanism to enhance early production to the detriment of a longer, but more productive oil recovery. By using the benefits of the injector and the downhole gas shutoff as described herein, the proper reservoir conditions may be identified and the recovery from the reservoir optimized. Ideally, the reservoir is relatively thick and has good vertical permeability. This provides a good mechanism for returning gas to the gas cap and enhancing the gravity drainage system. If gas were produced to create the optimum drawdown pressure in the annulus, then the gas may be re-injected back into the reservoir for conservation, and inefficient coning in the producing well still controlled. The effectiveness of the system with nitrogen, carbon dioxide and other injected gases is also practical.

The foregoing disclosure and description of the invention are thus explanatory thereof It will be appreciated by those skilled in the art that various changes in the size, shape and materials, as well in the details of the illustrated construction and systems, combination of features, and methods as discussed herein may be made without departing from this invention. Although the invention has thus been described in detail for various embodiments, it should be understood that this explanation is for illustration, and the invention is not limited to these embodiments. Modifications to the system and methods described herein will be apparent to those skilled in the art in view of this disclosure. Such modifications will be made without departing from the invention, which is defined by the claims.

What is claimed is:

1. A system for recovering liquids from a downhole formation and through a production tubing string, comprising:

a downhole injector for passing formation fluids though the injector and to the production tubing string while preventing gases from passing through the injector;

a packer positioned above the downhole injector for sealing a well annulus radially outward of the production tubing string;

a vent tube sealingly extended upward through the packer, such that gases pass through the vent tube and to the annulus above the packer;

one or more through ports establishing fluid communication between the annulus above the packer and the production tubing string above the packer; and a downhole pump positioned along the production tubing string above the one or more through ports for pumping liquids to the surface.

2. The system as defined in claim 1, further comprising:

a biased check valve along the vent tube, such that gas pressure below the packer maintains a desired liquid level in the annulus above the packer.

3. The system as defined in claim 1, further comprising:

a check valve positioned along the production tubing string at a position below the one or more through ports for preventing fluid which passes through the check valve from returning to the injector.

4. The system as defined in claim 3, further comprising:

one or more discharge lines fluidly connected to the production tubing string at a location above the check valve, such that fluid passes by the check valve and is discharged from a discharge port of the discharge line at a position above the one or more through ports and fluid returns from the annulus to the production tubing string through the one or more through ports at a position below the discharge port of the discharge line.

5. The system as defined in claim 4, wherein the check valve is positioned below the packer and within the downhole injector.

6. A method of recovering liquids from a downhole formation and through a production tubing string, comprising:

providing a downhole injector in fluid communication with the production tubing string;

positioning a packer above the downhole injector for sealing a well annulus radially outward of the production tubing string;

providing a vent conduit sealingly extending upward through the packer;

establishing fluid communication between the annulus above the packer and the production tubing string above the packer, such that gases pass through the vent tube to the annulus above the packer;

automatically passing formation fluids through the downhole injector and to the production tubing string while preventing gases from passing through the injector; and positioning a downhole pump along the production tubing string above the one or more through ports for pumping liquids passed through the downhole injector and to the surface.

7. The method as defined in claim 6, further comprising:

maintaining a gas pressure in the annulus below the packer to maintain a desired liquid level in the annulus above the packer.

8. The system as defined in claim 6, further comprising:

positioning a check valve along the production tubing string at a position below the one or more through ports for preventing fluid which passes through the check valve from returning to the injector.

9. A method of recovering liquids from a downhole formation and through a production tubing string, comprising:

providing a downhole injector in fluid communication with the production tubing string;

maintaining a gas pressure with a packer in an annulus about the production tubing string to act as a driving force to pass fluids into the production tubing string;

venting gas upward through the packer to pass gas from below the packer to the annulus above the packer;

establishing a fluid communication path between the annulus above the packer and the production tubing string above the packer;

providing a downhole pump along the production tubing string above the fluid communications path for pumping liquids to the surface; and passing formation fluids through the injector and to the production tubing string while preventing gases from passing through the injector.

10. The method as defined in claim 9, wherein venting gas upward through packer comprises providing a vent conduit sealing and extending upward through the packer, and providing a spring biased check valve along the vent conduit to maintain a desired liquid level in the annulus above the packer.

11. The method as defined in claim 9, further comprising:

maintaining a gas pressure in the annulus below the packer to maintain a desired liquid level in the annulus above the packer.

12. The method as defined in claim 9, further comprising:

providing a check valve along the production tubing string for preventing fluid passing through the check valve and in the annulus above the packer from returning to the injector.

13. The method as defined in claim 9, further comprising:

injecting a selected injection gas through a fluid injection line extending from the surface and through the packer to enhance the gas cap.

14. The method as defined in claim 9, further comprising:

positioning one or more lift valves along the production tubing string for selectively passing annulus gases through the production tubing string to raise slugs of liquid to the surface.

15. The method as defined in claim 9, further comprising:

positioning a second upper packer for sealing the well annulus radially outward of the production tubing string, the packer and the second upper packer forming an annular chamber;

providing a vent tube sealing extending through the packer and into the annular chamber;

positioning a check valve along the vent tube for maintaining a desired gas pressure in the annular chamber; and positioning one or more upper gas lift valves along the production tubing string above the second upper packer for selectively passing annulus gases through the production tubing string to raise slugs of liquid to the surface through the production tubing string.

16. A system for recovering liquids from a downhole formation and through a production tubing string, comprising:

a downhole injector for passing formation fluids through the injector and to the production tubing string while preventing gases from passing through the injector;

a packer positioned above the downhole injector for sealing a well annulus radially outward of the production tubing string;

a vent tube sealingly extending upward through the packer, such that gases pass through the vent tube and to the annulus above the packer; and one or more through ports establishing fluid communication between the annulus above the packer and the production tubing string above the packer;

a check valve positioned along the production tubing string at a position below the one or more through ports for preventing fluid which passes through the check valve from returning to the injector; and one or more discharge lines fluidly connected to the production tubing string at a location above the check valve, such that fluid passes by the check valve and is discharged from a discharge port of the discharge line at a position above the one or more through ports and fluid returns from the annulus to the production tubing string through the one or more through ports at a position below the discharge port of the discharge line.

* * * * *